United States Patent [19]

Britvec

[11] Patent Number: 4,646,504

[45] Date of Patent: Mar. 3, 1987

[54] FASTENING MEMBER FOR RETICULATED STRUCTURE

[76] Inventor: Stanislaus J. Britvec, P.O. Box 247, Orono, Me. 04473

[21] Appl. No.: 705,993

[22] Filed: Feb. 27, 1985

[51] Int. Cl.[4] ..... E04H 12/00

[52] U.S. Cl. ..... 52/648; 52/98

[58] Field of Search ..... 52/648, 98, 637, 632, 52/645, 646

[56] References Cited

FOREIGN PATENT DOCUMENTS

| | | | |
|---|---|---|---|
| 104150 | 3/1984 | European Pat. Off. | 52/648 |
| 2415743 | 10/1975 | Fed. Rep. of Germany | 52/648 |
| 2533721 | 2/1977 | Fed. Rep. of Germany | 52/648 |

*Primary Examiner*—Carl D. Friedman
*Assistant Examiner*—Naoko N. Slack

[57] ABSTRACT

A straight elongate structural member, and a structure incorporating such members, capable of rigid mounting at its ends into a reticulated structure to form one of a plurality of structural members forming that structure, the member comprising a straight elongate element serially interconnected with a load responsive means which at working loads axially applied to the member is rigid and which at a desired predetermined load, in excess of the working loads, axially applied to the member becomes plastically deformable the predetermined load being less than the critical load of the member when rigidly supported at its ends.

32 Claims, 40 Drawing Figures

FASTENING MEMBER FOR RETICULATED STRUCTURE

BACKGROUND OF THE INVENTION

1. Field of the Invention

The invention relates to the improvement of reticulated structures including truss and lattice types of structures, such as geodesic and related structures. But, it also establishes a new type of structural system, which can be built into shell-type three-dimensional curved lattices and other reticulated, truss-type, structures using prismatic or non-prismatic members, capable of very high load-carrying capacities compared to those of standard three-dimensional trusses.

2. Prior Art

Latticed structures, known as two- and three-dimensional trusses have been built in the past. Usually they were constructed of straight members of various materials, usually of steel, which were riveted or welded together at the joints or nodes by means of gusset plates or by other mechanical connections. Loads were applied at the joints of the upper or lower boom as the structure was supported on some foundation. However, the members in these trusses were kept stocky, not slender or light, in order to avoid what was observed to be the onset of flexural or torsional buckling in the members under purely axial loads. This buckling could not be allowed to occur as such buckling, invariably crippled the structure in a dynamic collapse As late as twenty years ago this phenomenon in trusses and space lattices of various kinds and, indeed, in light and slender structures in general, was not fully understood and the design codes of the day required that members in a truss were examined, individually for buckling, i.e., as if they buckled alone and not as constitutive elements of a system in which buckling of many members occurred simultaneously under the aspect of finite deformations.

It was thought that only the axial stress in each compressive member mattered and that, as long as that stress or the corresponding axial force remained below a permissible or critical value, the design would be safe. However, there always remained the doubt as to what that value was in a particular case, as discrepancies with the theory were constantly being observed. For pin-ended members in a truss, preselected criteria have been employed, tests have shown that the members collapsed well below the expected values, especially because in actual construction they were restrained at the ends and ideal pins, or hinges, could not be manufactured. In fact, the discrepancies between the failure loads were so large, that for certain slenderness ratios, i.e. the ratio of member-length to the radius of gyration of its cross-section; and, especially, if the members were designed to buckle in the inelastic or plastic range of deformations, it was impossible to predict when the member or column would fail. In this connection various formulas for the buckling or failure of individual hinged members or columns were devised allowing for the initial very small curvatures or eccentricities of loading involved. It was surmised that somehow these were responsible for the premature failures observed as buckling. Only later research revealed that the problem of buckling could be actually explained under the aspect of finite post-critical flexural deformations, causing the displacements of the member-ends or the nodes of a truss-type or other structure to occur and that in slender members the axial elongations or contractions resulting from axial strains were smaller or comparable to the second order displacements of the joints resulting from the contractions of these members due to purely flexural distortions, something which prior analyses never considered. It was then also discovered that minute changes in geometry and the imperfections in the structural elements had a very marked and pronounced effect in the entire phenomenon. This phenomenon has been more fully explained as extensive research into the post-buckling behavior of slender frameworks revealed the actual physical processes and as new physical laws governing the buckling of structural systems in general were discovered and these were formulated into a consistent and now established theory and analysis. Thus, under laboratory conditions, when the loads could be adjusted, it was found that under equilibrium conditions beyond a certain stage of buckling, or in the so-called range of post-buckling, elastic deformations of these structures could be increased as the external loads were being decreased. This paradox has been proven experimentally and explained theoretically for all known categories of elastic structural systems. These deformations remained elastic and the deformation can be cancelled or annulled by increasing the loads in a reverse process of diminishing deformation until the structure practically straightens to its prebuckled shape. See, for example, S. J. Britvec "The Stability of Elastic Systems", Pergamon Press, New York, 1973(450 pages), which is incorporated herein by reference.

Even today, structures of this type are commonly analyzed using the so-called linear theories. These theories assume that the analysis can be performed on the undeformed geometry of the structure in its initial position, or configuration, and that the elastic deformations of the structure do not need to be considered in this process to correct its initial geometry. In addition, it was assumed that these elastic deformations were always linearly related to the changing external loads, which is not true. Moreover, it was also erroneously assumed that, once the buckling deformations had set in and the buckling of the members developed by a finite amount, the external loads remained neutral in this process while the structure persisted in a state of equilibrium. This was also assumed to happen regardless of the type of connections or connectors, used to join the members at the nodes. It was also unknown that other structural parameters, such as the flexural contractions of the members or the parameters characterizing intrinsic geometrical imperfections or the nodal restraints in the structure, have a profound and indeed crucial effect on the form of buckling and on the intensity of the ensuing dynamic collapse and the relationship between these phenomena.

Thus the conventional design methods applied to such structures, especially when they exceeded a certain size, were always confronted with this unpredictable difficulty known as buckling, and its catastrophic consequences in large slender truss-type structures. Indeed buckling had to be avoided at all costs, as the designers wished to avoid or prevent a sudden dynamic collapse of the structure. The correct physical laws which governed the phenomenon of buckling had not yet been revealed, and the proper analyses which could be used to prevent this dynamic collapse by new design methods had not yet been discovered. As a result of the foregoing design problems, such structures were either avoided altogether, or they were overdesigned, that is, made stronger than necessary by keeping the members very stocky, thus resulting in heavy and uneconomical structures. In situations where the structural weight was a consideration, for reasons of cost and/or other modern applications such as structures for outer space, the conventional design methods became inadequate altogether.

Moreover, this buckling phenomenon was previously observed to be accompanied by a gradual development of deformations in the structure well below what was termed the critical range of loading when the onset of collapse followed. This was particularly prevalent in trusses and similar structures, such as portal frames or braced frames, which were built from slender and light members. It was just revealed (see the prior reference) that the resulting buckling deformations were nonlinearly related to the external loads. Therefore, these load-deformation curves or paths became known as the nonlinear equilibrium paths, and the structures which exhibited them as nonlinear structures.

The conventional analyses used before, therefore, did not apply to elastic structures beyond a certain degree of slenderness, or slenderness ratio, in the members in post-buckling. What was missing was the correct understanding of what the limits of the conventional linear analysis were and to which structures it could be applied. Nobody knew at that time how rigidly, or pin-jointed elastic trusses could be analyzed in post-buckling, nor whether equilibrium or an onset of motion in such structures was possible and what forms these can take. Subsequently, research has revealed that a physical process was present for which the governing laws were different than those considered to be operative before. The new theory turned out to be much more complex and it required a great deal of advanced knowledge and insight on the part of a designer or engineer to understand how such structures must be analyzed and what parameters and techniques were relevant for their safe design. One definite conclusion emerged. It was recognized that completely new types of structural systems evolved, once three-dimensional trusses were built beyond a certain size and slenderness of members, and that a totally different response was characteristic for such structures. Some of the characteristics of these relatively light new structures, requiring new and different analyses showed: (1) a gradual development of nonlinear deformations, in states of statical equilibrium, as the loading of the structure progressed; (2) a flexural character of deformation which in some cases was coupled with torsional deformations in the members; (3) a dominant role of the axial forces in the members in which the deformations occurred; (4) a rapid increase of distortions as the loads approached a critical region of loading, depending on many material and geometrical parameters of the structure and very strongly on the type of connectors exercising different end-restraints used to joint the members and a strong influence exercised by the flexural contractions of the members on the physical state of the structure; (5) a marked influence of certain very small geometrical imperfections, incurred in any manufacture of the members and the structure itself, on the shape of these nonlinear equilibrium paths; (6) a rapid change of physical state from statical equilibrium to a highly unstable motion which can result in a catastrophic collapse of the structure; (7) and above all, on a great diversity of equilibrium paths depending on the connectors used at the joints and the category of the structure itself, e.g. whether the connectors are soft, rigid, hinged, or the like, and an accompanying diversity of dynamic collapses some of which could be violent.

All this gave rise to various speculations as to how such structures, i.e., slender truss structure, could be made safer. It has become evident that some sort of new optimization techniques had to be devised in order to achieve an optimum design under the circumstances.

Further, modern research has revealed that after the onset of buckling in a perfect structure or in an imperfect structure where this onset is gradual mainly due to the initial imperfections, especially in truss-type structures with quasi-hinged or quasi-pinned connectors, many different modes, i.e. shapes of elastic deformation involving different sequences of buckling members distorting by different amounts, can take place.

It was further found that the buckled structure could be maintained in equilibrium even beyond that state of deformation where the sudden motion developed, provided that the external loads were suitably decreased, and that this decrease was different in different modes and in different types of structures. Thus, different categories of structural systems were discovered in which these modes occurred in very different nonlinear fashions, following the load-displacement equilibrium paths mainly of branching quasi-linear and parabolic shapes. Such structures with parabolic equilibrium paths were apt to develop much more catastrophic forms of collapse than those with nonparabolic and, initially, linear load-displacement paths. It was conclusively shown that the connectors determined what type of nonlinear paths were generated in structures made of slender elastic members, i.e. members with high slenderness ratios, and that quasi-hinged or quasi-pinned connectors were really the key to an optimization of slender trusses, as such connectors permitted the stiffening of individual members in the lattice.

With the foregoing discoveries it has been postulated that there should be an entirely new approach to the design of reticulated shell-type structures, geodesic domes and other more common types, such as slender lattices and trusses. This new approach was no longer limited by only the strength of the material, a normal criterion for design, but rather by the onset of a sudden motion accompanied by large flexural deformations under more or less constant loads corresponding to a critical state, became the governing factor for a safe design of such structural systems. The criteria for such designs, however, vary from one structural category to another. Thus, for example, lattices with hinged or quasi-pin-jointed members are subject to entirely different optimization and design methods than, for example, the rigidly-jointed lattices or reticulated shells or space-trusses. Some of the pertinent methods of analysis are described in the last reference hereinbefore cited. The most important observation in this regard is that these optimization techniques have revealed that dynamic collapse can be totally avoided or its intensity drastically reduced in a prescribed range of loading in trusses and space lattices jointed by quasi-pinned connectors which permit a selective stiffening of compressive members in a critical state, and that, if this collapse occurred at higher loads, its intensity could be drastically mitigated.

Therefore, the buckling process in any slender structure is something very different from what has been imagined. The most important discovery, notwithstanding its complexity, is that this process is strongly and qualitatively influenced by the type of connectors used to joint the members at the nodes and that appropriately designed connectors could drastically modify the course of its response to the external loads in a critical range. The role of minute geometrical imperfections is recognized to be extremely important but, provided these were kept under some measure of control in a manufacturing process, their effect on the statical response of the structure can be accounted for by analyzing the structure as if it were perfect and then, after determining from a model test what value the so called strong imperfection sensitivity parameter had, interpolating the corresponding imperfect path using the theory published in the cited reference, and others, see S. J. Britvec, "On the Nonlinear Behavior and the Stability of Reticulated Elastic Systems", in "Nonlinear Dynamics of Elastic Bodies", Springer Verlag, 1979, also incorporated herein by reference. Thus a verification of the response of any structure of this type can be accurately obtained. This theory is described and applied in the following reference, S. J. Britvec and D. Nardini "Some Aspects of the Nonlinear Elastic Behavior and Instability of Reticulated Shell-type Systems", Developments in Theoretical and Applied Mechanics, presented at the Proceedings 8th SECTAM, April 1976, and in another paper presented at the International Centre for Mechanical Sciences in Udine in Italy in the Lyapunoff Sessions on Modern Problems in Off-shore Engineering in 1980, S. J. Britvec "High Pressure Shells in Off-shore Engineering: "The Post-buckling Analysis of Reticulated Shells", (and most recently in "Post-Buckling Equilibrium of Hyperstatic Lattices", Journal of Eng. Mech. ASCE, 1985 in co-authorship with M. D. Davister), all incorporated herein by reference.

It has been found that there are definite advantages for the methods of analysis described. Optimization and design by which modern reticulated structures can be developed using the connectors described herein, over those built by conventional methods. Above all, the statical stability governed by buckling is thus made controllable and the load carrying capacity reliably predictable, provided, however, that during design, the correct physical laws are taken into consideration. The connectors of the present invention are designed so that the rotational flexibilities in the connectors are developed under the preselected loading conditions. Thereby only those modes of elastic deformation are developed which do not result in a catastrophic dynamic collapse but in which this collapse is mitigated, or controlled or prevented, so that up to a degree of nonlinear distortion, the structure is made to deform in stable or mildly unstable equilibrium. In the preferred practice of the present invention, the hinged action in the connectors never develops in a practical case as the intensity of loading is, by design, not allowed to attain such high values at which this becomes possible, but it is kept below a certain predetermined value dictated by an acceptable factor of safety. Thus, the potential for the development of these rotational flexibilities in the connectors is sufficient to guarantee the physical reality of the described hinge action and, thereby, ensure the stability of the structure in its elastic response.

Thus, the difficulties which existed before in regard to a dynamic collapse of such slender structures can be overcome in the practice of the present invention, by a more thorough understanding of the governing physical laws and by their consideration in the analysis and in the design of the required structural elements, which, depending on the required state of stress and limit loading applied to the structure, make the structure safe for a wide variety of design applications.

The desired hinge action in these connectors is brought about by means of a plastic hinge which is allowed to be induced in the connector in a specific location, where, under the action of the axial load, yielding of the material in the bending mode is produced locally at a grooved neck. This is possible, because at such a neck a certain stress concentration can be brought about due to the geometrical profile of the neck, as soon as the axial force in the member and therefore in this neck, has attained the prescribed intensity corresponding directly to the load applied to the structure externally at its peripheral nodes. These rotational flexibilities or hinges make the adjoining member act as if pinned about the two plastic end hinges situated in the end connectors, so that under the action of the axial force and the geometrical imperfections, it can bow out or buckle as soon as this force becomes critical, which means induced by the external limit loading. If this state is achieved with all those compressive members which when bowing out or buckling simultaneously constitute the desired non-dangerous or stabilized mode of elastic deformation in equilibrium, then the entire structure will deform in a safe manner while stability is still ensured. Those compressive members, which, if they buckled simultaneously, would cause an undesirable kinematic mechanism or mode to develop, are simply stiffened and so prevented from buckling and, as a consequence, the undesirable mode is eliminated. In this manner, only using a systematic approach described later in more detail, the structure can be optimized for its structural stability and a relatively high load carrying capacity to weight ratio.

End connectors which permit the formation of the so called plastic hinges in the ultimate or the critical state of loading are but one device which permits an optimization of a reticulated structure, shell or lattice of the type described. Two and three dimensional truss type structures composed of prismatic or non-prismatic members may be made, according to the present invention, without these flexibilities or rotational freedoms using stiff or semi-stiff, i.e. elastic connectors. However, their response may be very different from that of the systems of the present invention which are made of optimized and plastically hinged connectors, as described herein. That is, they may not be readily optimizable against dynamic instability by the same methods, as described. However, practically any type of truss-type structural systems lends itself to the analysis described herein to design and make structures which will exhibit the described properties, however such structures are highly dependant on the type of connectors used and the methods of nonlinear analysis and optimization in post-buckling vary accordingly.

Further, insertion of additional or redundant prismatic or nonprismatic members into the statically determinate or isostatic lattice of hinge-connected members, having connectors which bear the potential for the formation of plastic hinges under the critical axial forces in these members, makes it possible to increase substantially the load carrying capacity of the lattice. These hinge connected members, when redundant, can buckle simultaneously with the other isostatic compressive, i.e. statically determinate members of the lattice, only if their flexural shortenings are kinematically compatible with one of the modes of post-buckling deformation of these isostatic members. If this is not the case, one or all the modes, comprised of the isostatic members, are prevented from forming at the prescribed level of loading altogether and the loading must be increased further in order that other compressive members within the lattice become sufficiently stressed, and then they may buckle so as to permit the formation of another kinematic mechanism or buckling mode, but now at higher values of the external loads, corresponding to a higher load carrying capacity of the structure. So, if the teachings of the present invention are exploited systematically or methodically, they can be utilized to increase the load carrying capacity of reticulated shells and space lattices. This applies whether buckling is viewed along an equilibrium path, or in a dynamic process or collapse under constant external loads. This also applies to preventing certain buckling modes from occurring in an existing lattice by making it simply statically and kinematically inadmissible.

The process of inserting additional connector-attached members into a structural lattice system to increase its load carrying capacity, can be applied to different types of space elements, such as tetrahedrons combined with ocathedrons, and the like in the formation of space lattices of various shapes which may be curved or flat. Space lattices and reticulated shell type structures can, in the practice of the present invention, consist of polyhedral space elements in which every member serves as the edge of at least two adjacent space elements. Lattices composed of a combination of cube-tetrahedron combination of space elements, have different mechanical properties from those composed of a combination of tetrahedrons and octahedrons, for example. Such arrays of space elements can be combined in larger blocks or super elements and these blocks can be optimized to possess certain desireable properties, depending on the overall geometry of the structure and on the external loading. The most common type of structural forms are dome-shaped structures used for the coverage of large areas, but other shapes, such as hyperbolic paraboloids have gained prominence in more recent times, especially for the construction of large cooling towers. Practically, lattices of any geometrical shape lend themselves to the construction from space elements that will endow such lattices with high and controllable load carrying capabilities.

One other important application of the present invention is to flat or curved large space structures in aerospace engineering applications, such as radiometers, antennas and the like. Such structures must normally undergo complex interorbital maneuvers while they are subjected to considerable inertial loads. The control of these structures in this motion depends critically on the accurate response of the large lattice, as well as on the desired controllability properties which can only be imparted to the lattice if it is properly analyzed and optimized as explained hereinafter.

Three dimensional lattices have, of course, been built before. The structures of Buckminster Fuller, and the Mero-Company in Germany are notable examples. However, none of these structures were designed with regard to an optimal load carrying capacity to weight ratio in the critical and post-critical range of loading and finite deformation using the present invention. In none of these standard structures would the prevention or the control of the dynamic collapse be possible, because such structures are not fitted with connectors which make this possible. The standard methods of analysis and design, used for these structures, do not apply beyond a certain range of slenderness, because they do not consider adequately the finite post-buckling flexural deformations and the end rotations of individual members which govern the response and the statical behavior, as well as the stability of such structures.

OBJECTIVES OF THE INVENTION

It is therefore an objective of the present invention to provide structural elements that can be employed in reticulated structures and provide for new design criteria for such structures resulting in their superior strength, stability and load-bearing to weight ratios.

It is a further objective of the present invention to provide a method for analyzing and implementing the design criteria for structural elements in reticulated structures to produce a higher performance structure than has hitherto been produced in regard to the global structural stability and controllability of its overall shape, an optimization with regard to various other objectives, such as increased imperfection insensitivity and minimal instability in the collapse process, as well as its local and global stiffness and strength.

BRIEF SUMMARY OF THE INVENTION

The present invention represents structural systems made of polyhedral space elements (e.g. combinations of tetrahedrons and octahedrons or cube-tetrahedrons etc.) which, in turn, are made of slender tubular or solid members jointed together by special types of connectors. The structural system of the present invention can constitute a space lattice enveloped by a cover-shell, supported at the outer or inner peripheral joints or nodes, so that any pressure on this outer or inner shell may be transmitted to the lattice at these nodes.

The system of the present invention can take various structural forms. It may be built as a flat three dimentional lattice or as a curved lattice supported on a foundation along its edges. It may also be freely suspended in outer space as a large space structure such as a radiometer, antenna, or the like, and preferably as a reticulated shell.

External loads are usually applied to such a lattice at the peripheral nodal points, either transmitted by the cover-shell or applied directly. They are further transmitted axially through the various members of the lattice to the foundation if the lattice is supported. The connectors suitable for the assembly and the performance of a reticulated shell on the ground may be very different from those employed in a large space structure deployed in outer space. In either application, however, the connectors may be made from metallic, non-metallic or any other material capable of performing under load as described herein. In the latter case, they must also be deployable in space and also satisfy the requirements necessary to make the folding of the individual members possible and to comply with an efficient deployment mechanism. The members in a large space structure can be very light and very slender tubular members endowed with folding joints if necessary.

The materials selected for these members may vary widely depending on the application. In reticulated shells used to cover relatively large areas on the ground they can be made of high tensile steels. In large space structures, in which the weight is the main consideration, the members may be made of light synthetic materials or composite materials such as, for example, graphite cloth glued together by epoxy resins and shaped into different cross-sections, or the like. It is thereby possible to produce structurally strong members with very desireable mechanical properties which are of a very light-weight.

The key to the controllability of the deformations and the response of such slender systems can be found in the reliable controllability of the flexibility of the connectors which connect the members to the nodal spheres. The actual arrangement is shown in detail hereinafter to provide the superior structural properties and relatively high stability and load bearing capacity to weight ratio described herein.

Shell type structures contemplated herein are usually reticulated shells and, if endowed with certain optimized properties, to be described later they may be called the high-strength reticulated shells or space lattices, because of their relatively high load-or pressure carrying capacity to weight ratios. Essential for these high load bearing capacities of the lattice are special connectors fitted between the member ends and the socketed nodal spheres to which the members are attached. These connectors are provided with local circular grooved necks which, under a certain near critical magnitude of the axial and slightly eccentric load in the members they connect, can develop a high local flexibility and rotation in the bending mode at this point. The slight eccentricity of the axial load in the member is provided by the intrinsic minute geometrical imperfections inherent in every member. This bending flexibility at the neck of the connector results from the formation of the so called plastic hinge at this point under the action of the prescribed axial load in the member, regardless whether this load is compressive or tensile. This property is achieved by the local mechanical properties of the material and by the geometrical shape of the respective part of the end-fitting connector, both of which cause locally concentrated stress pattern to occur at the neck which initiates the formation of the plastic hinge at that point.

This formation of the plastic hinge takes place at or near the critical region of loading of the structural member. This critical region is the region at which the member will just begin to buckle under load (the member is said to be on the "point of buckling") when its ends are supported by "ideal" hinges (i.e. hinges having no resistance to motion in any bending direction). This critical region of loading can be calculated using known formulae assuming an axially loaded member of perfect geometry (e.g. no eccentricities, no external moments at ends and no curvature) or can be experimentally approximated on compressive testing equipment (e.g. using a Southwell plot). The plastic hinge is then preferably designed to bend at a load of 100% to 130% (typically 105% to 115%) of the critical range of loading as calculated for the "ideal" hinge. Since the hinge is stiff before it achieves plasticity under load, it will normally act as a stiff connection and the member will perform, prior to plasticity occurring in the hinge (neck of the connector pin), as if it were stiffly connected and elastically restrained at both ends. Since the critical region of loading for the member when restrained at both ends will be higher—region as much as 1 to 4 times higher—than the critical region of loading for the ideally hinged member (4 times, if both end-joints to which the member is attached, are initially completely prevented from rotation and the member ends remain elastic when buckling begins) the member will resist buckling until the plastic hinges form at or near the prescribed axial load. At this time however, the formation of the plastic hinges serves both to limit the axial load in the member to its critical or near critical value and to redistribute the loads in a non-destructive manner through the connecting elements supporting the plastic hinges.

Hence, applied loads are redistributed throughout the space lattice or truss, while it is being loaded by increasing external loads applied centrally at its nodes and while the buckling of the members remains constrained. This state of constrained buckling of a member is only possible in a statically indeterminate or hyperstatic lattice, which contains more than the necessary number of pin-jointed or quasi-hinged members to make it just-stiff. Constrained buckling persists until the external loads have been sufficiently increased, so that in the process, a required number of compressive members become critically stressed (loaded) and unrestrained buckling of these members can take place in a local or global, kinematically admissible, buckling mechanism within the lattice, or truss. At and beyond this point, the lattice or truss deforms by buckling as a quasi-pin-jointed or quasi-hinged structure, while the plastic hinges form. This unrestrained buckling process of deformation may take place in states of equilibrium or in motion if the equilibrium is unstable, depending on whether or how the external loads are adjusted. The plastic hinges also serve to dissipate the total potential energy of the system and thereby mitigate the rate of this motion or process.

The analysis described herein and the inventive concept of the present invention is applicable to structural members having a slenderness ratio (i.e. the ratio of length to radius of gyration) in all ranges, starting with the normal or intermediate range of approximately 40:1 to 80:1 or 100:1 and it greatly facilitates the use of compressive members with higher slenderness ratios than are currently used in reticulated structures, for example ratios in excess of 100:1 or much higher are anticipated. These higher ratios are possible due to the new analytical and structural optimization methods set forth which permit accurate prediction of the statical stability of the structure and of the performance of such members in post-buckling of complex hyperstatic quasi-hinged lattices, trusses or reticulated structures. A major advantage of using such ratios is the significant increase in strength to weight ratios of structures using them.

Thus, when fitted to the member ends these connectors make the members of the lattice quasi-hinged or quasi-pinned when the external and the corresponding internal axial loads attain prescribed critical values or intensities. So, for example, when the necked-down portions of the connections become plastic during the initial deformation, as a sufficient number of the compressive members in the lattice become critically stressed, these members begin to bow out simultaneously forming a statically and kinematically unconstrained buckling mechanism in which the structure begins to deform globally. This mechanism may proceed in states of statical equilibrium, if the loads are adjusted gradually to follow the required equilibrium path, or it may occur in sudden motion if the loads remain constant retaining their critical values, in which case the structure collapses dynamically. The state of loading or internal stress in the structure which just precedes the formation of this collapse mechanism is called the ultimate critical state. It should be stressed that the statical process of buckling does not necessarily coincide with the buckling modes or mechanisms which are possible from the ultimate critical case in a collapse by motion. Most of these modes proceed along the decreasing equilibrium paths, i.e. where an increase in the elastic deformation of the members is accompanied by a decrease in the applied loads or in their load parameter. If buckling is dynamic, i.e. it proceeds under constant loads, the resulting mode is usually associated with the largest negative changes of the total potential energy of the system measured from that ultimate critical state, i.e. the state in which a buckling mechanism may be formed by the plastic hinges. This will be explained in more detail hereinafter. The ultimate critical state depends exclusively on the overall geometry of the structure, its material properties, the connectors used, and on the system of external loads applied to it.

In any buckling mechanism, whether static or dynamic, the members which are on the point of buckling and which begin to bow out or buckle and do not unload nor remain straight, do so about the end hinges being formed in the connectors such as described herein, under the intensities of the axial loads in or near the critical state. This formation of plastic hinges, according to the present invention, absorbs a certain amount of available total potential energy of the system, so that less energy is available for conversion into kinetic energy which constitutes a measure of the intensity of the dynamic collapse of the structure. Thus, the formation of plastic hinges also serves to damp or to reduce the intensity of the dynamic collapse of a reticulated structure under constant external critical loads. Moreover, plastic hinges, as described herein, give rise to small restraining end moments which always act in the manner opposing the elastic bending of the compressive member connected by two such hinges and this invariably results in a slightly higher critical load in the member itself and, ultimately in all the members subject to buckling within the lattice, and therefore, in a improved overall load bearing capacity of the structure. This is, however only one element or ingredient which increases this capacity of the structure. There are several more considerations which increase the load carrying capabilities of the lattice or the reticulated shell, more fully described hereinafter.

For example, if certain members in a statically determinate or isostatic hinged or quasi-hinged lattice, which are on the point of buckling and eventually would bow out unrestrained in a buckling mechanism, are stiffened, then the particular mode of buckling can be eliminated.

On the other hand, if certain members in a statically indeterminate or hyperstatic pin-joined or quasi-hinged lattice or truss, which are on the point of buckling and eventually would bow out unrestrained in a buckling mechanism, are prevented from doing so by other hyperstatic members in the lattice, then such members are constrained from buckling completely and they are capable of supporting a critical or near critical load, until a required number and sequence of redundant (hyperstatic) members become critically stressed in compression as the external loads are proportionately increased such that the members in this sequence can continue to buckle and an unrestrained buckling (post-buckling) mechanism may form. The state at which this occurs is called the ultimate critical state of the structure as defined. In this post-buckling mechanism some compressive critically loaded members may unload axially and remain (practically) straight in this mechanism, while other critical compression members, which are on the "point of buckling" in the ultimate critical state, continue to bow out or buckle. However, such a particular mode of post-buckling can be eliminated if one or several buckling members in this post-buckling mode or mechanism are stiffened or otherwise prevented from buckling. Therefore, the structure can be programmed to a certain extent as to the buckling modes it may elicit. Obviously, that the modes associated with smaller negative changes in the total potential energy of the system are the more desireable, because in these modes, as already described, the intensity of the dynamic collapse is smaller or mitigated.

If a lattice is made of quasi hinged members, i.e. members with connectors which have the potential to develop plastic hinges under predetermined axial forces which are referred to as critical, and their number is sufficient to make the lattice stiff enough, i.e. statically determinate or isostatic, then, as the external loads are increased proportionately, the axial forces in its members can be determined from static analysis. If, on the other hand, the lattice contains redundant members, additional conditions of axial strain compatibility in the members at the nodes and the compatibility conditions of flexural shortenings of the bowing out or buckling members must be considered, (as explained, for example in "The Stability of Elastic Systems", chapter 7, Pergamon Press, New York, 1973 and in other publications by the inventor which are incorporated herein by reference), in the analysis to determine the axial loads in the members in the sub-critical, ultimate critical and post-critical equilibrium states of the lattice. Eventually, under a so- called critical or ultimate-critical state of loading a certain sequence of events occurs. For example, under such loading, compressive members always become critically stressed so that they begin to bow out or buckle flexurally while the external loads can be increased only slightly. Further, when these members pivoting about the plastic hinges of the present invention form in the end connectors under that state of stress, buckling of these members becomes unrestrained, and the flexural deformations continue to develop and the external loads can no longer be necessarily increased in statical equilibrium. This sequence of compressive members can then determine the minimum number of buckling members for a particular structure. This mechanism allows the structure to distort globally or locally and its joints together with the applied loads to be displaced accordingly.

If anyone of these compressive buckling members is stiffened, i.e. replaced by another member having a flexurally stiffer cross sectional area, then this mechanism cannot occur at the same state of loading, (other mechanisms, involving different compressive members, may be possible at the same state of loading, unless prevented in a similar manner), but the loading has to be increased in intensity, usually proportionately, in order that the same or another sequence of compressive members may become sufficiently stressed for the described process to occur. In this process the axial stresses can be redistributed, before the same or an alternative sequence of critically stressed compressive members can begin to bow out, pivoting about the end hinges formed within the connectors which connect them to the nodal spheres. This then causes the structure to deform globally in the same or another mode, depending on which sequence of compressive members is buckling.

Such a buckling mode can proceed in statical equilibrium if the loads are correctly adjusted and stabilized to follow an equilibrium path, or in motion, if the system is unstable and the loads remain constant, but the corresponding mode may be different from an equilibrium mode. Usually, on such an equilibrium path, an increase of elastic deformations in the members is accompanied by a decrease in the load parameter of the external loads. Under such conditions equilibrium is said to be unstable. Namely, if the loads are not decreased proportionately, the structure is set off into an unstable motion from any point on this path under the constant loads corresponding to this point of loading, so that the motion results in the collapse of the structure.

Therefore, a stiffening technique which may consist of simultaneously stiffening several compressive members, bounded by the plastic hinges in their respective connectors, becomes a means of increasing the total load bearing capability of the lattice or the structure of which the lattice is a part.

Another technique for increasing the load bearing capability of an isostatic lattice consists in adding additional or redundant members to the lattice, i.e. beyond that minimum number that makes it just- stiff. If the lattice now contains (r), such redundant members, then, for a global mechanism involving all the redundant members to develop, at least (r+1) members in this lattice must be compressive and critically stressed, so that they are on the point of buckling and actually begin to bow out, before such a lattice can begin to deform globally. On the other hand, the redundant compressive members may be so stiffened that only some are on the point of buckling in the ultimate critical state and the lattice develops only a partial or local post-buckling mechanism, in which parts of the lattice do not develop unrestrained buckling of the members. But, for such a state to be achieved, the external loads must be increased considerably above the level at which only the members of an equivalent isostatic lattice begin to bow out. These additional or redundant members are said to constrain the isostatic lattice from buckling. In this manner the load bearing capacity of a given isostatic lattice may be increased several fold.

Obviously, the iso-static, as well as these additional or redundant members are attached to the nodal spheres by means of the same type of specially designed grooved or profiled connectors which are described hereinafter, which permit the formation of the plastic hinges under the axial loads or local stresses induced in these connectors by the higher external loading for which the structure is now designed or optimized. It is therefore proposed that a lattice, either curved or flat, can be built, according to the present invention, to carry considerable external loads, the totality of which may be far in excess of its own weight, before a kinematic mechanism, involving a sufficient number of bowing or buckling members, can be formed.

The structures and designs of the present invention and its embodiment into an actual reticulated shell or a large space structure is made possible by means of the structures described herein which have the potential for the development of the rotational flexibilities, such as plastic hinges in the optimized mode of elastic or plastic deformation of the members themselves and thus ensure, as already described, the bowing out of the buckling members in this mode according to the result of such an optimization. These connectors are displayed graphically and their functioning more fully described hereinafter.

The graphical representations of FIGS. 12 to 20 are concerned with structural elements (members) having slenderness ratios in the range of approximately 105 to 195.

Figure 20:
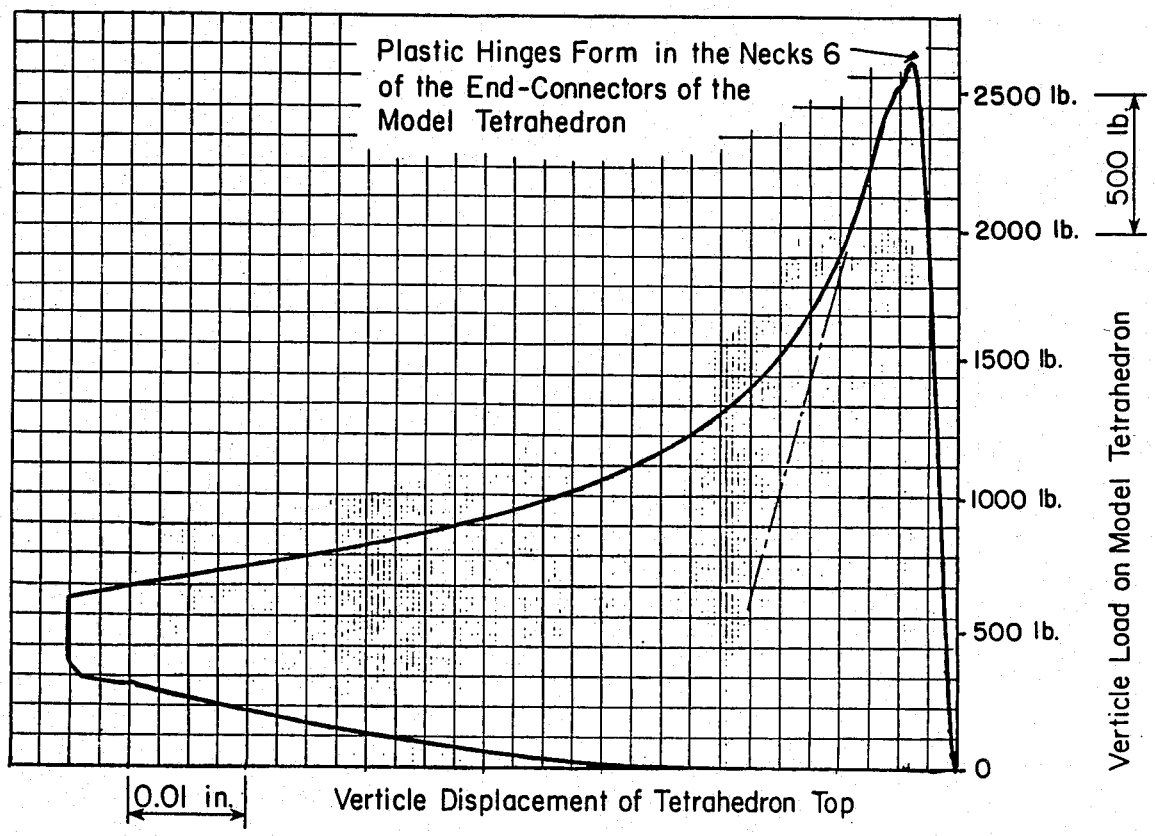
FIG. 20 is a graphic representation of the relationship between the vertical load, applied at the top joint of a tetrahedron space element such as that shown in FIG. 5, and the vertical displacement of this joint.
Figure 20A:
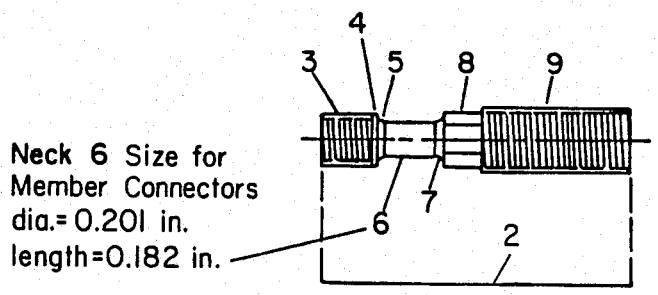

FIG. 20*a* shows the connector pin 2 with neck 6 of 0.201 inches in diameter and 0.182 inches in length used in the test described in Example 5 and characterized in FIG. 20.

DETAILED DESCRIPTION OF THE DRAWINGS

Figure 1:
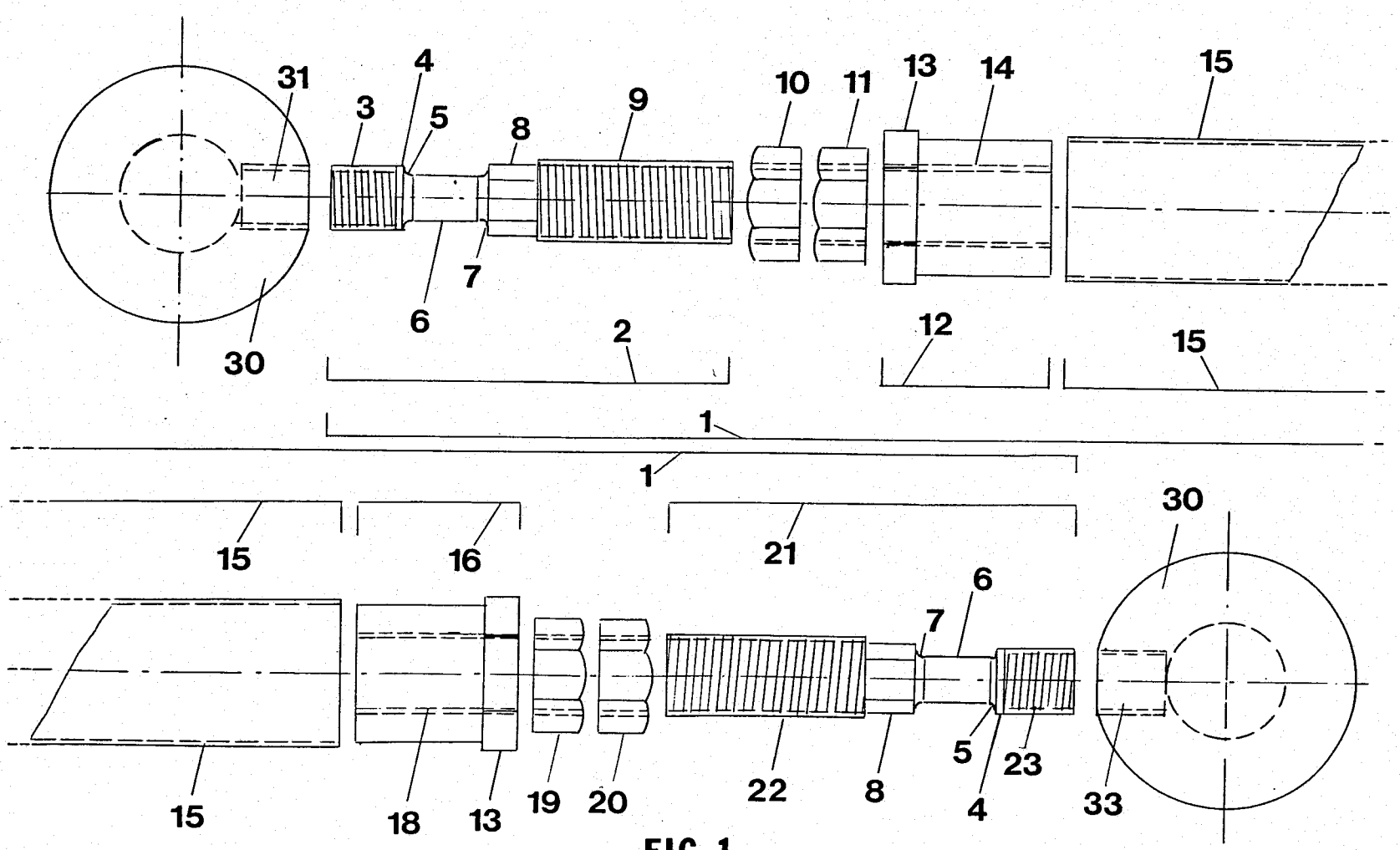
FIG. 1 is a partially broken plan view of a connector of the present invention useful in a reticulated structure.
Figure 3:
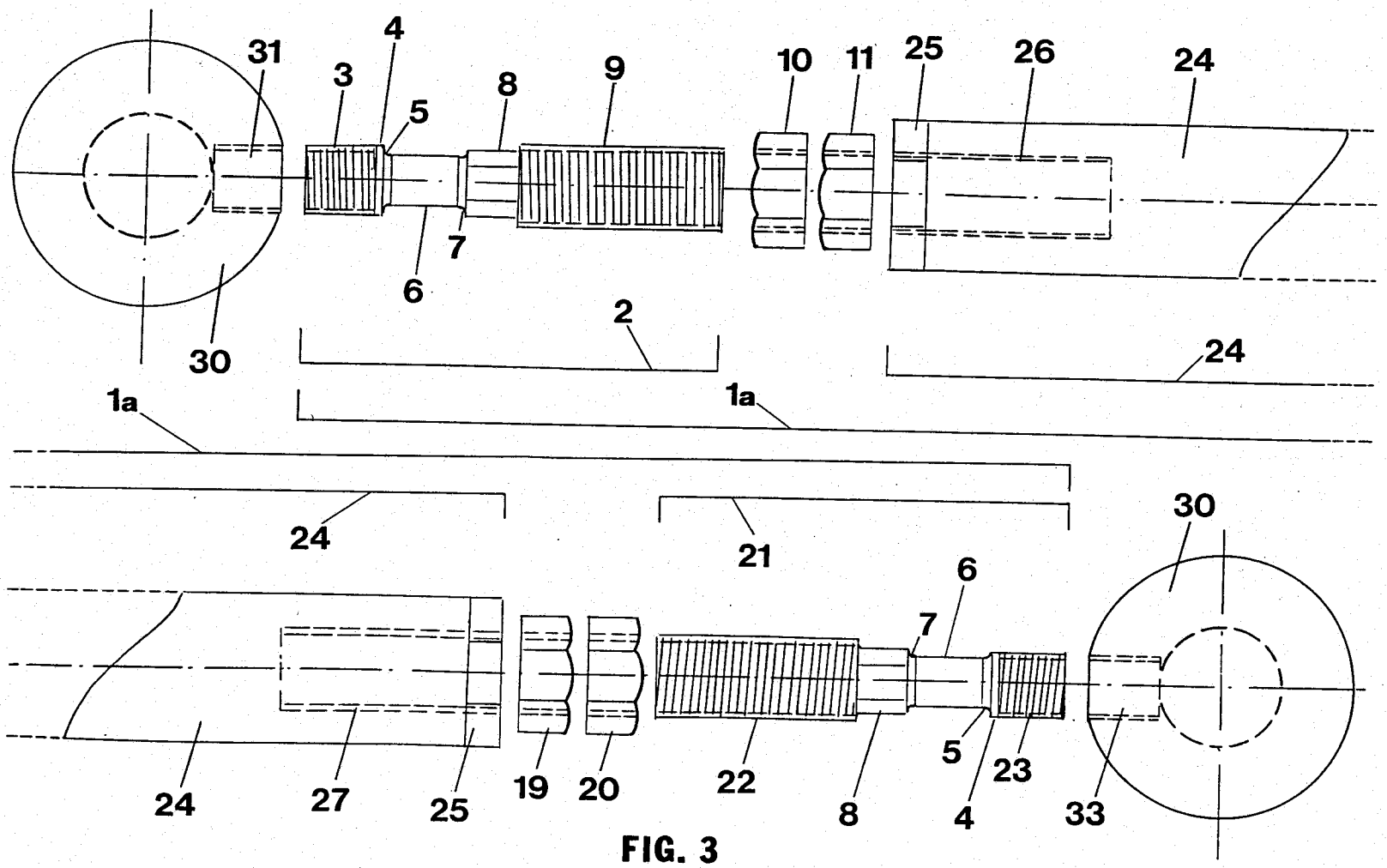
FIG. 3 is a partially broken plan view of another connector embodiment of the present invention.

A typical hollow member 1 used in the present invention is shown unassembled in FIG. 1 and a typical solid member in FIG. 3. Member 1 in FIG. 1 consists of a right-threaded connector pin 2 and an opposite left-threaded connector pin 21, the right-threaded locking nuts 10 and 11, the opposite left-threaded locking nuts 19 and 20 together with a recessed sleeve or bushing 12 with a right-threaded hole 14 and a recessed sleeve or bushing 16 with a left-threaded hole 18 and a high-tensile steel tube 15.

The right-threaded connector pin 2 has a frontal right thread 3 and a dorsal right thread 9. The outside diameter of the dorsal thread is larger than that of the frontal thread so that the locking nuts 10 and 11 can slip freely over the frontal thread. These nuts thread onto the dorsal thread 9. Adjacent to the frontal thread is short, flat circular shoulder 4 followed by the necked-down portions 5, 6, and 7. The portion 5 is grooved in by a small radius of curvature and so is the portion 7. The radii of curvature of the portions 5 and 7 are usually, although not necessarily, equal. The neck portion 6 is usually, although not necessarily, cylindrical. The geometry of the necked down portion of the connector pin is very important to achieving the overall objective of the present invention. The portion 8 is hexgonal, such that the locking nuts 10 and 11 can freely slip over it.

The opposite left-threaded connector pin 21 is identical to the connector pin 2, except that its frontal thread 23 is left-handed and its dorsal thread 22 is also left-handed. The remaining parts are identical to those of the right-threaded pin 2 and are labeled accordingly. The frontal left-handed thread portion goes into the correspondingly left-threaded hole 32 in the adjacent nodal sphere 30. The dorsal left-thread 22 is threaded to receive the locking nuts 19 and 20.

The recessed sleeve 12 has the outside diameter such that it fits tightly inside the tube 15. The sleeve has a threaded hole 14 to receive the dorsal thread 9 of the connector pin 2. The sleeve has a hexagonal edge 13 to accommodate a spanner. The function of this edge is explained hereinafter in the description of the assembled member in FIG. 2.

The opposite recessed sleeve 16 is the same as the recessed sleeve 12 except that it has a left-threaded hole to receive the left-threaded dorsal thread 9 of the opposite pin 21.

Figure 2:
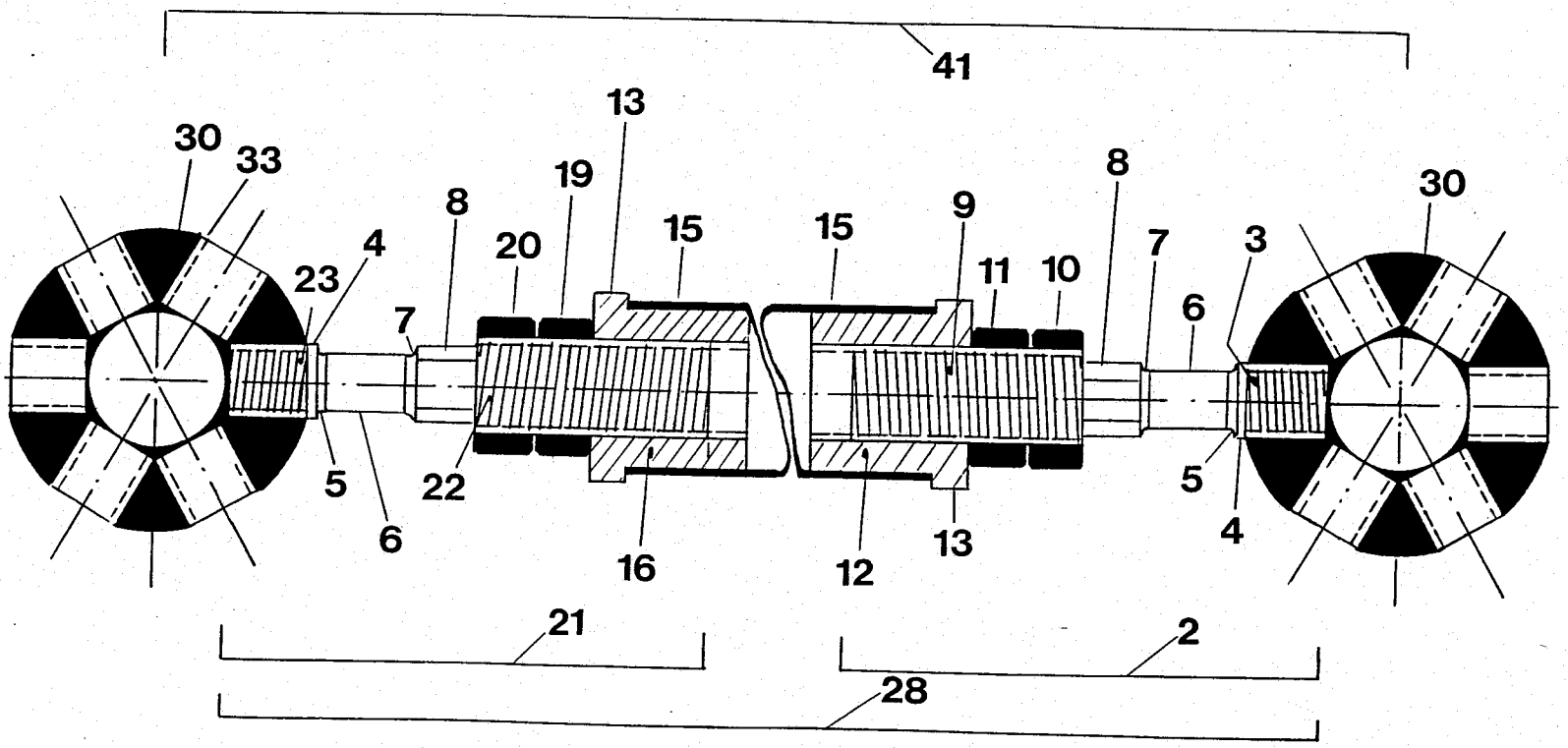
FIG. 2 is a partial cross-sectional view of a connector of the present invention with end nodes.

The assembled member 1 is shown in FIG. 2 and it is labeled by the number 28 between the tips 3 and 23 of the frontal threads of the opposite connector pins. This member is assembled as follows: the recessed sleeves 12 and 16 are inserted into the opposite ends of the high-tensile tube 15 and fastened by conventional attachment means to the tube. Then the dorsal right-thread 9 of the connector pin 2 is threaded into the right-threaded hole 14, FIG. 1, of the recessed sleeve 12 and, similarly, the dorsal left-thread of the connector pin 21 into the left-threaded hole 18, FIG. 1, of the recessed sleeve 16. The locking nut 11 is slipped on over the frontal thread 3, the hexagonal part 8, and threaded onto the dorsal thread 9 but not tightened, while the second nut 10 is hanging loosely over the neck 6. Similarly, the opposite locking nut 19 is slipped over the frontal thread 23, the hexagonal part 8 and threaded onto the dorsal left-thread 22, but not yet tightened against the sleeve 16, while the second nut 20 is hanging loosely over the neck 6 of this pin 21. Both pins 2 and 21 are then threaded further into their respective sleeves 12 and 16 so that the member-length 28 between its ends is reduced and the member can be inserted between the two neighboring nodal spheres 30 which are assumed to be here in fixed positions. One of the pins, say 2, is then threaded into position as shown in FIG. 2, and the nut 11 tightened against the sleeve 12 by means of a spanner. The tube 15 with its bonded sleeves 12 and the tightened pins 2 and 16 is then turned so that the frontal thread 3 of pin 2 is threaded into the threaded hole 31 of the adjacent nodal sphere 30. This pin 2 is then tightened by applying a spanner to the hexagon 8 of pin 2. The second locking nut 10 can be threaded onto the exposed dorsal thread 9 but not tightened, as shown in FIG. 2. At that time, the opposite left-threaded pin 21 is threaded a sufficient amount out of the left-threaded hole 18 of the opposite sleeve 16, and its frontal left-thread 23 is threaded tightly into the hole 32 of the adjacent nodal sphere 30, FIG. 1. This is accomplished by applying a spanner to the hexagon 8 of this pin 21. Only when the first pin, in this case pin 2, is in place, the opposite pin 32 is threaded in the opposite direction into the adjacent hole 32 of the nodal sphere 30 and tightened. The locking nut 19 is then roughly in the position of the second locking nut 20, shown in FIG. 2, and the nut 20 is hanging loosely over the neck 6 on pin 21.

At this point, the member length 28 and the center to center length (gauge length 41, FIG. 2), between two opposite and connected nodal spheres 30 are checked for minute adjustments using a special gauge, not shown or described herein. If this gauge length is too long, the connecting member 28, FIG. 2, is shortened by loosening the locking nut 11 (it is assumed the opposite locking nut 19 is already loose) and turning the tube 15 with its bonded sleeves 12 and 16 clockwise, looking in the direction of the right-threaded connector pin 2, by applying two spanners (one may be sufficient) to the hexagonal (or square) parts 13 at the opposite sleeves 12 and 16. In this operation, the opposite left-threaded pin 21 previously tightened into the opposite nodal sphere 30 adjacent to it, is drawn into the hole 18 over the dorsal thread 22, pulling with it the opposite nodal sphere 30 and reducing the gauge-length 41, FIG. 2, and the member length 28. A slight lengthening of this or a similar member is accomplished in the same way by turning the member-tube 15 with its bonded end-sleeves 12 and 16 in the opposite, counterclockwise direction. After this adjustment, the locking nuts 11 and 19 and the additional locking nuts 10 and 20 are tightened firmly and the member is assembled. If one of these nodal spheres and its connector pin are free, this length is more easily adjusted by turning the tube 15 with its two end-sleeves 12 and 16 around, say, the dorsal thread 9 of the pin 2, which is assumed to be previously tightened into the fixed nodal sphere 30 and by independently turning the opposite free nodal sphere 30, with its connector pin 21 tightened into it, about its dorsal thread 22, until the gauge length 41 between the fixed and the free nodal spheres 30 and the member length 28 are adjusted to a preselected dimension. Then, the locking nuts 11 and 19 and the additional nuts 10 and 20 are tightened and the member is correctly assembled as shown in FIG. 2. If both nodal spheres are already fixed within the lattice, this adjustment may be accomplished subsequently by loosening the locking nuts 10, 11 and 20 and 9 and by turning the tube 15 with its attached sleeves 12 and 16 by means of two spanners applied to the hexagonal edges 13 of these sleeves, in a clockwise or counterclockwise direction around the oppositely threaded dorsal threads 9 and 22. Thus, the member may be minutely shortened or lengthened, depending on the sense of this rotation, as the opposite nodal spheres are pulled together or apart. Only minor adjustments may be accomplished in this way to avoid excessive initial stressing of the two connector pins. Once the gauge length is adjusted, the tightening and locking nuts 10 and 11 and 19 and 20, respectively, are tightened and the member is locked into position with the required gauge-length. Such adjustments may be carried, out simultaneously on several members assembled in the lattice.

This operation may be accomplished with only one locking nut at each end, say using only the nuts 10 and 20. In that case the dorsal threads 9 and 22 may be somewhat shorter. The use of two locking nuts at each end merely serves to safeguard the locking operation and the member length while the structure is under axial stress and to avoid any looseness of the members between the opposite connector pins and the tubular members with their two bonded sleeves.

A typical solid member 1*a*, is shown unassembled in FIG. 3. This member consists of the identical parts as the hollow member in FIG. 1, except that now a solid bar 24 replaces the tube 15 and the end sleeves 12 and 16 shown in FIG. 1 are absent. The hexagonal ends 25 are provided to hold the solid bar 24 from rotating during assembly. Thus, the right threaded pin 2 is identical as before and so is the opposite left-threaded pin 21. Identical also are the locking nuts 10, 11 and the opposite left-threaded nuts 19 and 20. The neck-down portions 5, 6 and 7 are basically the same, except that the dimensions of the necked cylindrical part 6 and the radii of curvature of the grooved parts 5 and 7 may be different.

New in this type of member are the right-threaded hole 26, which receives the dorsal thread 9 of the connector pin 2, and the left-threaded hole 27 at the opposite end of the solid bar 24, which receives the dorsal thread 22 of the left-threaded opposite pin 21. The depths of these two threaded holes must be at least equal the lengths of the dorsal threads 9 and 22 within the hole when the member is aligned shown in FIG. 2, plus at least the lengths of the frontal threads 3 and 23 respectively, so that the connector pins may be threaded into the holes 31 and 32 of the respective adjacent nodal spheres 30 in the same manner, as described for the assembly of the hollow member 1 before.

Figure 4:
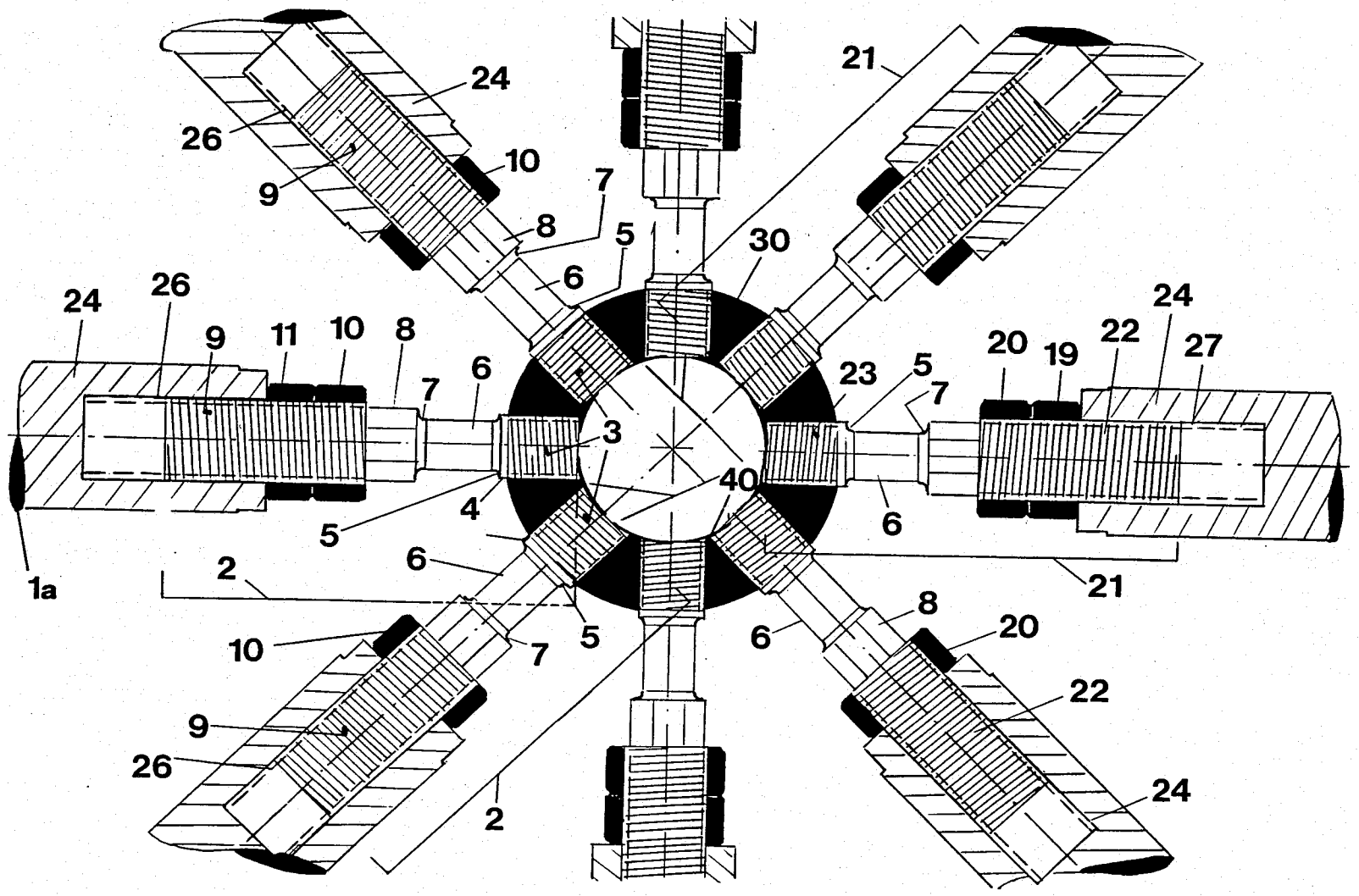
FIG. 4 is a partial cross-sectional view of a series of connectors according to the present invention fastened to an end nodal sphere.

The assembled members 1*a* with one and two locking nuts 10 and 11 or 19 and 20 respectively are shown in FIG. 4.

A typical joint 40 connecting eight members in one plane is shown in FIG. 4. The hollow nodal sphere 30, the locking nuts 10, 11 of a typical right-threaded connector pin 2 and the locking nuts 19 and 20 of a typical left-threaded connector pin 21 are shown cut (blackened). Also the solid bars 24 are shown cut. Typical connector pins 2 and 21 are shown uncut. One end of a typical member 1*a* with a solid bar and two locking nuts 10 and 11 is shown in the assembled and locked configuration. Similarly, such typical end-connectors 2 and 21 are shown with only one locking nut 10, and 20.

The hollow sphere 30 is assumed to have been designed by standard design methods to withstand safely the compressive and tensile axial loads of the adjoining members under equilibrium conditions. Similar hollow spheres of this type have been used in standard engineering applications to plane and space trusses and they have withstood the stresses imposed by eight or more adjoining members in a three-dimensional configuration without problems. Solid spheres could also be employed. The compressive and tensile axial forces transmitted by the eight members are assumed to act along the center lines of the elements, meeting at the center of the nodal sphere 30.

The members shown in FIG. 4 would be put in place as described for the assembly of a single typical hollow member 1 in FIG. 2, except that now the recessed sleeves 12 and 16 are absent and the threaded holes 26 and 27 in the solid bar 24 act in their place.

A peripheral joint may be free on one side, say the topside, in which case the three top members in FIG. 4 would be absent. The threaded top hole may be used for a fastener pin (not shown) which would connect the cover-shell (not shown) to the peripheral nodal sphere 30. This cover-shell, together with a typical fastener-pin is not shown, because there may be a great variety of such cover-shells and materials of which they are made and the fastener pins would be different in each case. Moreover, the type of attachment of the cover shell to a typical peripheral node is not essential for the explanation of the structural function, which the special connector-pins shown fulfill in the present invention.

Figure 5:
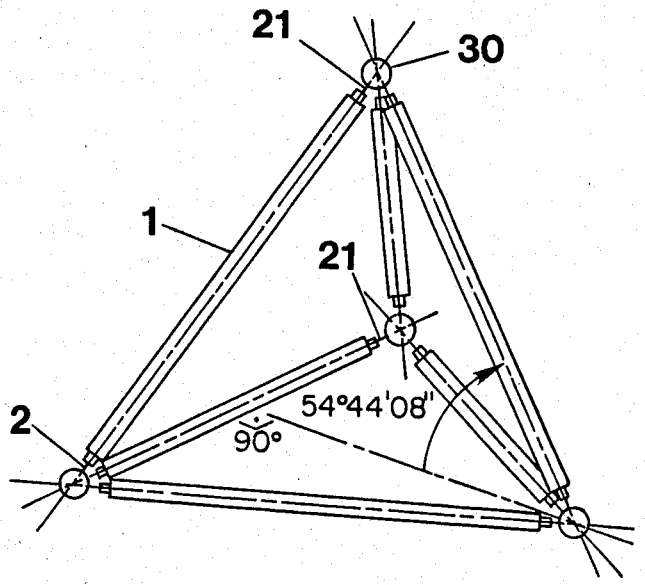
FIG. 5 is a perspective illustration of a typical tetrahedron of connectors and structural elements and nodal spheres of the present invention.
Figure 5A:
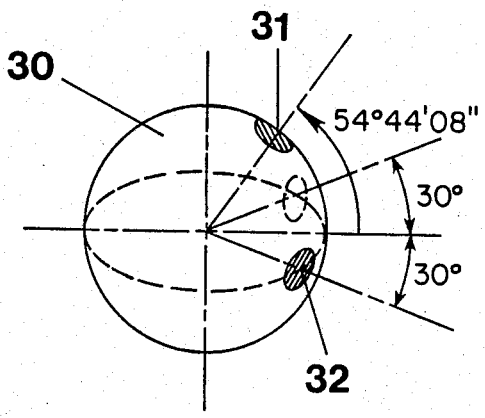
FIG. 5*a* is a perspective illustration of a typical nodal sphere alone as used for the tetrahedron in FIG. 5.

FIG. 5 shows a typical tetrahedron element, which constitutes only one such element within a space lattice. It consists of six (6) members (tubular 1 or solid 1*a*) assembled in a manner shown in FIG. 2 or FIG. 4. These members are jointed to the four nodal spheres 30, in the manner indicated in FIG. 4, by means of the special connector pins 2 and 21, which are also indicated in FIG. 5. There, all six members have equal lengths and these, with the angles of member axes, are indicated for a tetrahedron model space element, which was actually tested. This test is described later. A typical solid nodal sphere 30, is shown in FIG. 5*a*. It is provided with radially threaded holes 31 and 32 to receive the frontal threads 3 and 23 respectively of the connector pins 2 and 21. The axes of these holes are shown for a tetrahedron of six equal members at the correct angles indicated in FIG. 5*a*.

Figure 6:
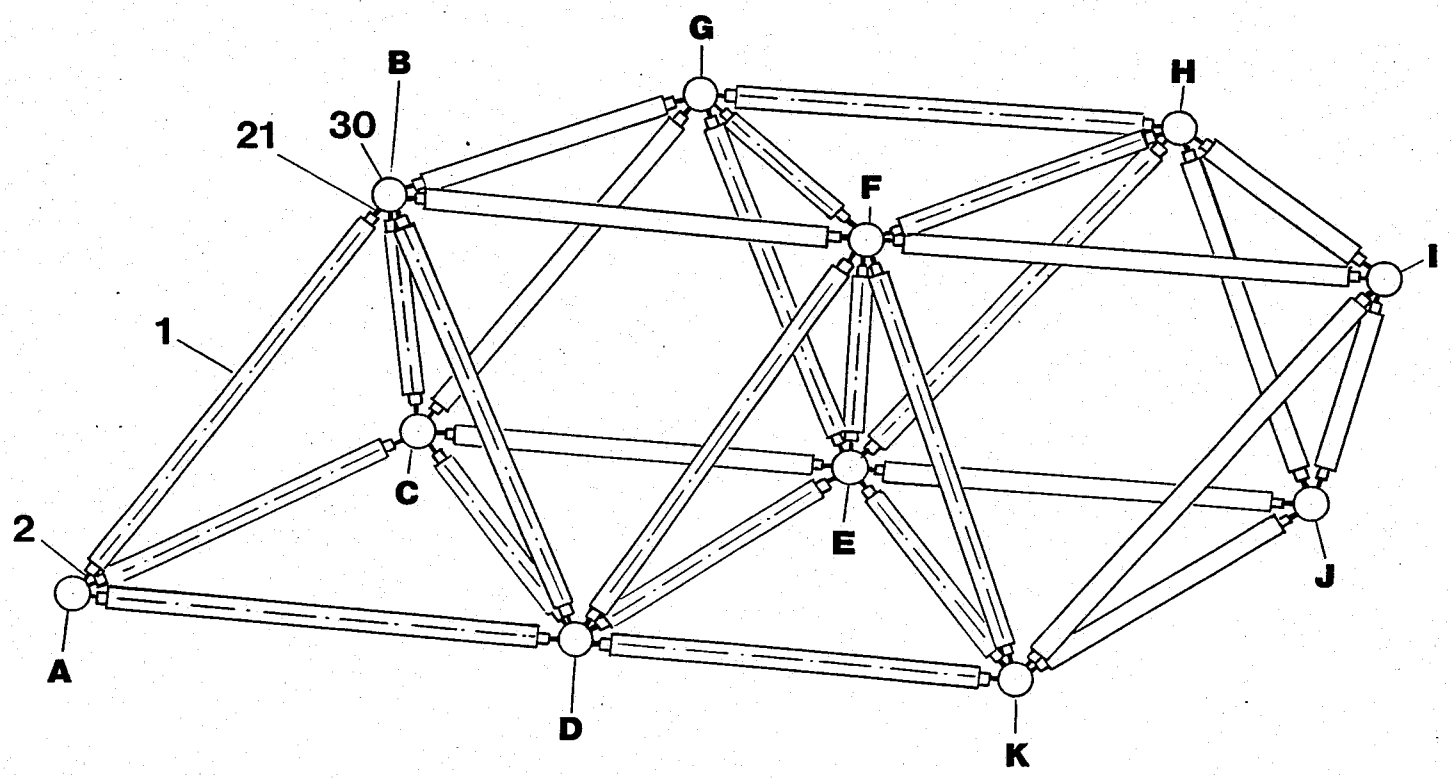
FIG. 6 is a perspective illustration of a portion of a lattice utilizing the present invention with tetrahedron and octahedron elements.

A larger array of polyhedral elements consisting of three tetrahedrons and two octahedrons is shown in FIG. 6. The tetrahedrons, shown with chain-dotted center-lines are situated between the joints A, B, C, D and the joints D, E, F, K and E, F, G, H. The tetrahedron E, F, G, H is here inverted. The two octahedrons are located between the joints B, C, D, E, F, G and the joints E, F, H, J, K.

These polyhedrons are composed of individual members, such as 1, which are connected to the nodal spheres 30 by the special connectors 2 and 21, shown in detail in FIGS. 1, 2, 3 and 4. Some of these members are "shared" by two adjacent polyhedrons. For example, the members B, C and B, D and C, D are shared by the left-most tetrahedron A, B, C, D and the adjacent octahedron B, C, D, E, F, G.

A polyhedral array of members of this kind represents a space lattice. Such a lattice may be externally supported at some of the peripheral joints and it may be loaded by concentrated external loads applied centrally at the remaining joints. These loads may be applied directly, or they may be transmitted to selected joints by a cover-shell (not shown in FIG. 6), at those nodes where this shell is attached to the nodal spheres 30 of such an array. For example, if the array in FIG. 6 is part of an even larger array in which the joints B, F, G, I are among the top peripheral joints, this cover-shell would be attached by other special fasteners to these joints and the external pressures, applied to the cover-shell, would be transmitted to the space lattice as concentrated loads applied centrally at these nodes.

Figure 7:
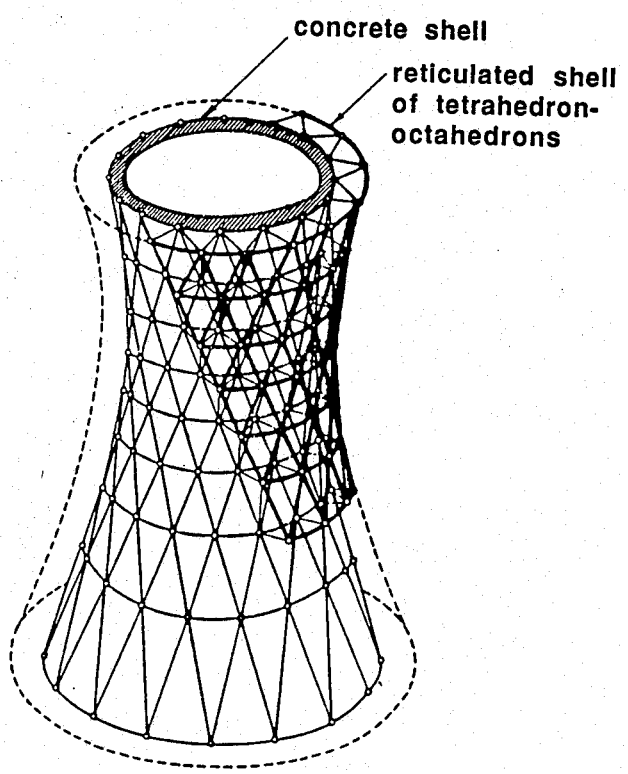
FIG. 7 is a partial perspective view of a hyperbolic-paraboloid shell using the present invention.

Much more elaborate lattices of very high strength can be formed using octahedron and tetrahedron space elements shown in FIG. 6. A geometrically closed lattice made of a combination of tetrahedron-octahedron elements in the shape of a hyperbolic paraboloid shell for a cooling tower is shown in FIG. 7. Each bar or edge represents an assembled member of the type 1 or 1*a* or 28 or 29 respectively, which is common to at least two adjacent space elements, i.e. tetrahedron and an octahedron. These members are connected to the nodal spheres, shown as small circles in FIG. 7, by means of the special connector pins 2 and 21 respectively, threaded into the opposite ends of each member as described. The members on the inner and outer layers lie on axially concentric hyperbolic-paraboloid surfaces, as shown in FIG. 7. Therefore, their assembled lengths are generally different. However, due to axial symmetry of the shell, all peripheral members lying on a circle and those diagonal members lying on each hyperbolic-paraboloid surface, between two horizontal polygonal concentric rings of members are also of identical lengths. Similarly, many diagonal members between the inner and outer layers are of identical lengths because of axial symmetry. Thus, not all members need be manufactured to a different size since many members can be identical.

In this case a cover-shell made of light concrete is shown attached to the hyperbolic-paraboloid lattice at the inner peripheral nodes. Such a connection may be accomplished by special fastener pins threaded into the nodal spheres at one end and grouted into the concrete cover-shell at the other. The function of this cover-shell, in this case, is to provide a necessary cooling surface for the hot water which is pumped to the top and let to cool as it falls down on the inner wall of this cover-shell.

The outer layer may be covered by another cover-shell (not shown in the figure), which gives the tower an aerodynamically better shape and reduces the wind-loading on the tower by eliminating air turbulance. In that case then, the wind pressure would be transmitted to the lattice centrally at the outer peripheral nodes, where the outer cover-shell may be attached. Such reticulated cooling towers may be built in excess of 150 meters in height. This height constitutes the approximate limit to which cooling towers made of reinforced concrete only, may be safely errected.

Figure 8:
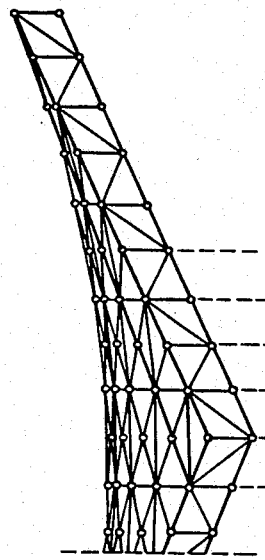
FIG. 8 is an enlarged view of several of the cube tetrahedron elements used in the structure of FIG. 7.
Figure 8A:
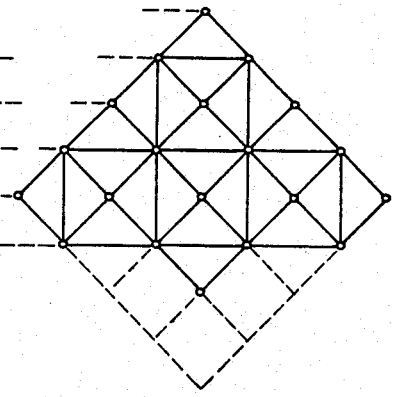
FIG. 8*a* is a plan view of the elements used in the structure shown in FIG. 8.
Figure 8B:
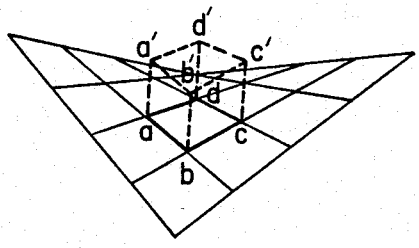
FIG. 8*b* shows the outline of a typical single space element used in the structure of FIG. 8.
Figure 8C:
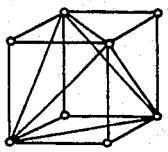
FIG. 8*c* shows a typical cube tetrahedron space element used in the structure of FIG. 8.

In FIG. 8*b*, a segment of another hyperbolic-paraboloid lattice, made of a different polyhedral array consisting of assembled members of the type 1 or 1*a* or 28 and 29 respectively, is shown. These space elements consist of a cube and an inlaid tetrahedron made of single members 1 or 1*a* and jointed to the nodal spheres 30 by means of oppositely threaded connector pins 2 and 21. Such a cube-tetrahedron element is shown fitted onto the inner hyperbolic-paraboloid surface in the space (a, b, c, d, a', b', c', d') in FIG. 8. The consecutive members, now situated on the inner or the outer hyperbolic-paraboloid surfaces, follow a straight line. The figure also shows a segment of the assembled hyperbolic-paraboloid lattice composed by such cube-tetrahedron elements. The assembly of such a segment of the lattice from single members of the type 1 or 1*a* attached to nodal spheres of the type 30, proceeds in exactly the same manner as described before. No cover-shell is shown for this lattice in FIG. 8.

Figure 9:
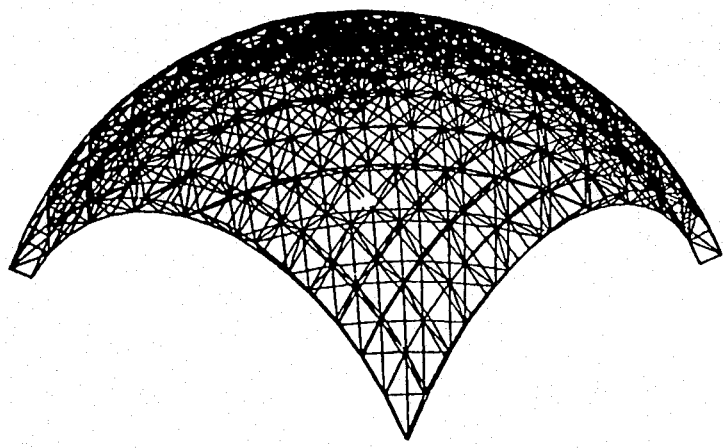
FIG. 9 is a perspective view of a spherical lattice utilizing the present invention.
Figure 9A:
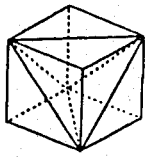
FIG. 9*a* is a view of a typical cube tetrahedron building block in the spherical lattice in FIG. 9.

In FIG. 9 an even more complex polyhedral array of cube-tetrahedron elements is shown in the shape of a spherical lattice. These elements are identical to those shown in FIG. 8 except that now their members have different lengths. The inner- and outer-layer members lie on two concentric spheres which are bounded by four arches. The nodal spheres indicated by small circles are of the type 30. This spherical lattice may be supported at the peripheral nodes situated on the four peripheral bounding arches and it may be enveloped by a cover-shell (not shown in FIG. 9) over the top layer attached by other special fasteners to the top peripheral joints of this lattice. Thus, any external pressure applied to such a cover-shell from the top would be transmitted to the spherical lattice centrally at its peripheral top-nodes by concentrated forces. Such a supported lattice then constitutes a reticulated shell-type structure.

The Structural Response of the Described System

The systems of the present invention then consist of solid or hollow members of the type 1 or 1*a*, jointed into a three-dimensional curved array or lattice by means of special connectors of the type 2 and 21 to nodal spheres 30. This lattice may be enveloped by a cover-shell, not described in this text. Such a lattice may be supported on a foundation at the peripheral nodes along its boundary. The transmission of the external loads and pressures distributed over the cover-shell (not shown in the figures) to the lattice occurs by way of concentrated forces applied centrally, at the top peripheral nodes, where the cover-shell and the lattice are attached in a quasi-pinned manner by fasteners (not discussed in this text). Thus the lattice is loaded only at some of its nodes by concentrated external or reactive forces, which are in a state of equilibrium and which are ultimately proportional to an external load parameter. Usually, proportionate external loads are implied. As the external loads, or pressures applied to the cover-shell and transmitted to the lattice, are increased, then also the axial loads in the members of the lattice are increased correspondingly. These axial loads may be calculated in terms of the external load parameter from the conditions of statics and from the initial strain or displacement compatability conditions between the adjoining members at any one node, using the standard theories. Thus, the axial load carried by each member in a static or quasi-static loading process is uniquely defined by the value of this external load-parameter.

The connector pins 2 and 21, shown in FIGS. 1, 2, 3, and 4 are made of a treated material. Any material may be used. A suitable metal material may be a mild or stainless steel. The material is such that in the necked-down regions 6 it develops a pronounced yield point on the stress strain curve, which may occur at a certain fairly constant stress with only little tensile or compressive strain hardening at large plastic strains of some 0.020 in./in. In the region 6 the material has to be "tough" and ductile, so that it can withstand very high local bending deformations in its plastic range under direct axial stress and without this stress significantly surpassing its yield point or limit. A typical stress-strain diagram, based on experimental results, for the connector in the necked down region 6 is described hereinafter. The crosssectional area of the neck 6 in every member in a truss is so designed, that just before the required compressive or tensile load in the connector pin in the critical state of loading is fully realized the stress-concentration in the regions 5, 6 and 7 in each pin induces plastic yielding in the neck 6. The radii of curvature in the adjacent grooved regions 5 and 7 of the pin are responsible for the degree of this stress concentration, this also depending on the transition or step-down in the outside diameter between the adjacent narrow, flat cylindrical shoulder 4, the adjacent hexagonal part 8, and the diameter of the cylindrical neck 6, (or the least cross-sectional dimension of this neck 6, if not cylindrical) FIG. 1, as well as on the length of the neck 6. This stress concentration initiates the local plastic yielding process in the neck 6 in the near-critical stage of loading. Then, only a small additional restraining plastic bending moment (M) in the neck 6 is required, for a small rotation, localized in the plastic region of the neck 6 to take place at each end of any member taking part in the buckling mechanism. This additional plastic moment (M) is initiated by slight initial geometrical imperfections, such as a very slight initial curvature in the member between the opposite nodal spheres 30 or a very minute non-parallelity between the cross-sectional boundaries between the narrow stiffened flat shoulder 4 and the adjacent groove 5 and the boundary between the groove 7 and the adjacent hexagon 8, inherent in every practical member. Under the critical loading the initial growth of this plastic bending moment and the localized plastic hinge rotation in the neck 6 are influenced by a slightly non-uniform distribution of the axial and shearing plastic strains and stresses in the neck 6. At first, this occurs without a strain-reversal in the longitudinal direction of the neck, i.e. a local or partial decrease in compressive strains and stresses, as the initial plastic resistance in the hinge is overcome by the elastic buckling of the member pivoting about the necked-down regions 6 at its opposite ends under an increasing axial load P, FIG. 11, and later, with a strain-reversal under a decreasing axial force.

Figure 10:
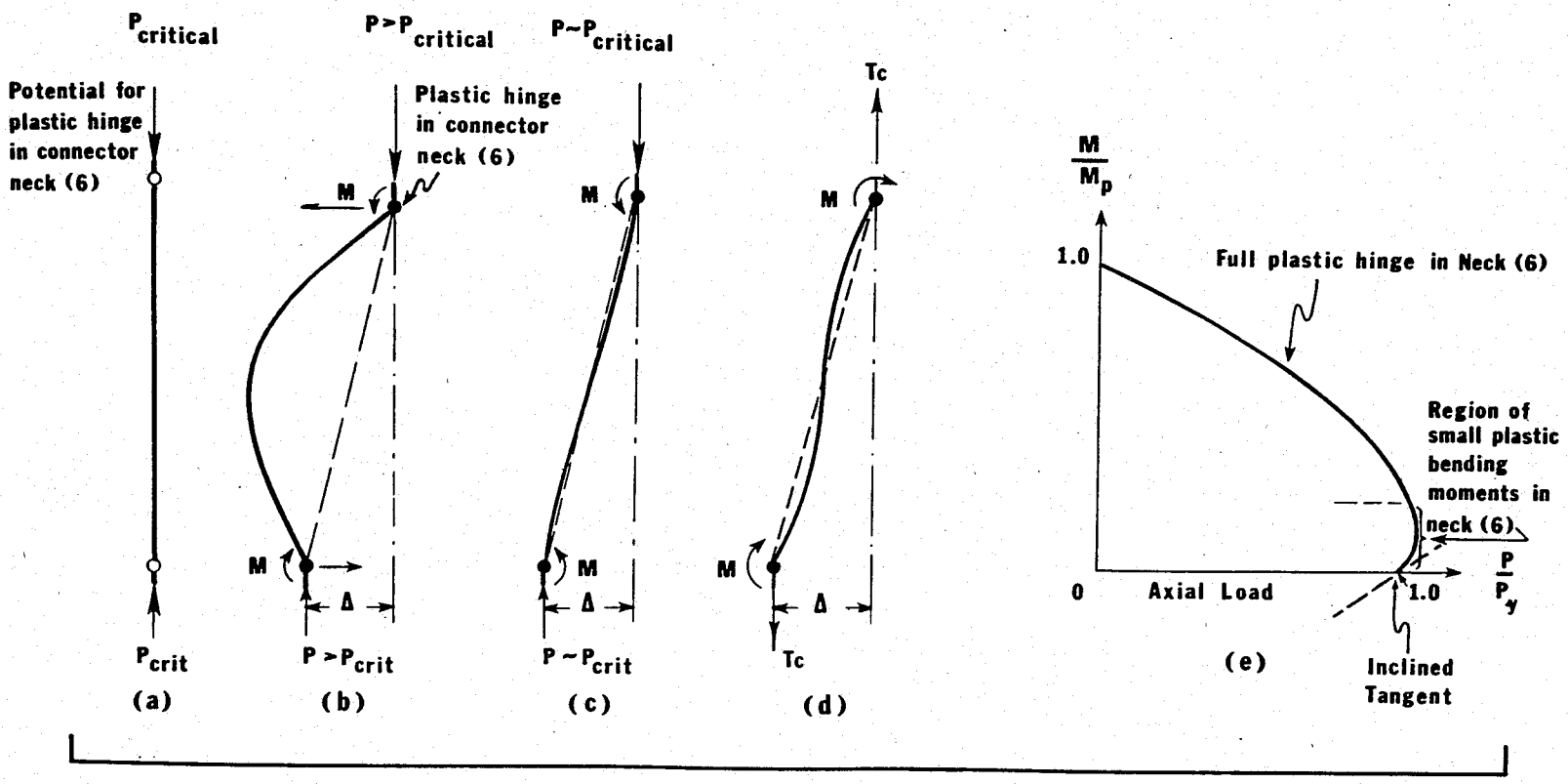
FIG. 10 shows schematic representations and an explanatory graph showing the functioning of the connectors and attached structural elements of the present invention.

In reference to the assembled member in FIG. 2, this buckling action proceeds as follows: plastic hinges are formed simultaneously in the neck-down regions 6 of the opposite connectors 2 and 21, while the assembled axially compressed member is practically straight and constrained from buckling by the constraining bending moments (M) in these regions. When the axial load in the member 28 is sufficiently increased, the member has the tendency to buckle. This increase may be beyond that critical axial load, ($P_{crit}$), FIG. 10, which would be necessary for this member to buckle elastically, if the plastic hinges in the locations (b) were replaced by ideal pins. This means that the member parts consisting of the opposite hexagonal portions 8, the dorsal threads 9 and 22 with the tightened locking nuts 10, 11 and 19, 20 of the opposite connector pins 2 and 21 and the tube 15 (or the solid rod 24) with the bushings 12 and 16 between them, take up a slightly curved elastic configuration, resembling a bow, spanning on one side of the member axis between the opposite necked-down regions 6. At the same time, the adjacent nodal spheres 30, at either end of the member may be displaced relative to each other by an amount (Δ), as buckling of this and other members in the lattices develops. This is also shown in FIG. 10*b*.

In tensile members, the yielding in the opposite necked-down regions 6 is brought about by the rotating action of the member, which pivots bodily about its ends at the yielding necked-down regions 6 under a relatively large tensile axial load. This bodily rotation then affects the same material parts 8, 9 and 22 with the tightened locking nuts 10, 11 and 19, 20 of the opposite connector pins 2 and 21 and the tube 15 with bushings 12 and 16 or the solid rod 24 between them, of an assembled tensile member 28, FIG. 2, similarly as this is the case in compressive assembled members, described previously. In tensile members the yielding process and the formation of plastic hinges in the neck-down regions 6 at opposite ends proceeds similarly as in compressive members, except that there is a lesser apparent strain-hardening effect in the necks 6, after the onset of first yielding, as described in more detail later. In this yielding process during the bodily rotation of the member, the adjacent joints with the nodal spheres 30 are simultaneously displaced relative to each other by an amount (Δ), so that the tensile forces acting on the tensile member between the tightened thread 3 and the adjacent neck 6 at one end, and the tightened neck 23 and the adjacent neck 6 at the opposite end, become slightly eccentric, producing small local bending moments (M) in these necked-down regions, as indicated in FIG. 10(*d*). These moments, together with the axial stress in the member, are then responsible for the localized plastic yielding and the formation of plastic hinges in the regions 6. Such bodily rotations occur in and beyond the critical state of loading in both tensile and compressive members, including those initially critically stressed compressive members which do not develop buckling, but remain practically straight under a slightly decreasing or nearly constant axial compressive load, while taking part in the development of a global or local buckling mechanism within the lattice or truss. Such members only bend slightly elastically between the opposite necked-down regions 6 and rotate bodily between these regions, as indicated in FIG. 10*c*. This slight elastic deformation, which may be in single or double curvature along the member length, embodies the same parts 8, 9, 22 with the tightened nuts 10, 11, 19, 20 and tube 15 with bushings 12 and 16, FIG. 2, or solid rod 24, FIG. 3, described previously for the elastic buckling of a typical compressive member.

Most important for an adequate localized plastic yielding and an adequate localized, relative rotation of the cross-sectional boundary between the hexagon 8 and the groove 7 and the cross-sectional boundary between the groove 5 and narrow flat cylindrical shoulder 4 in the connector pin 2 or 21 across the neck 6 where the plastic hinge forms, is the ratio of the length of the cylindrical neck 6 to the diameter of the same neck (or the least cross-sectional dimension of the neck if not cylindrical), as well as the neck profile which includes the adjacent grooves 5 and 7. The neck is usually cylindrical in the region 6, i.e. between the grooved regions 5 and 7, as indicated in FIGS. 1 and 2, but it may also be slightly tapered or concave at its mid-point, the concave side of the surface of the neck pointing away from the axis of the connector pin. (The neck 6 may be also prismatic or non-cylindrical, having a least cross-sectional dimension, so that the plane of the plastic moment in the neck 6 may be prescribed relative to adjacent nodal sphere 30.)

If the axial load in the member in the critical state is compressive, the member begins to bow out and buckle elastically except at the plastic hinges in the necks 6 at the two opposite ends. This buckling process in the members within the lattice becomes unrestrained and simultaneous following the ultimate critical state in the loading process, at which a sufficient number of compressive members are simultaneously critically loaded in the axial direction, so that the formation of the plastic hinges in the necks 6 of the member connectors can begin.

The overall critical state in the lattice or truss is determined by a single value of the external load parameter. This state is followed by the plastic yielding in the neck-down regions 6 of all the members and by the development of plastic hinges in these regions, which cause the development of an overall buckling mechanism in the truss. In this mechanism the buckling members bow out, while tensile and unloading compressive members mainly rotate bodily, pivoting about these plastic hinges forming at the ends as described before. Thus, not all the initially critically stressed compressive members necessarily buckle in this mechanism and the mechanism may be partial, involving only a part of the truss or lattice or it may be global involving all the members in some kind of bodily displacement, rotation and elastic deformation.

Two basic states in this buckling process must be distinguished. First, the incipient or initial critical state, which is brought about by the external loads, when these reach their ultimate critical values in the loading process. In this state, the system, i.e. the structure under these ultimate loads, is on the point of developing a buckling mechanism as plastic yielding in the necks of their connector pins is about to begin and many compressive members within the lattice are on the point of buckling (i.e. they have the potential to buckle, but have not yet buckled) about the plastic hinges which are forming at their opposite ends. Second, a developed state of buckling, which characterizes the development of this buckling process into a global or local buckling mechanism or mode within the lattice, involving the developed buckling of a precise set, but not necessarily of all the initially critically stressed compressive members. These developed states take place in the so-called post-buckling range of deformation and loading, in which only one, among many possible buckling mechanisms or modes, has fully developed.

Therefore, the first state characterizes the potential of the structure to develop a buckling mechanism or mode under a set of external loads applied to it, whereas the second state concerns the development of a distinct buckling mode, involving the actual buckling of a precise set of initially critically stressed compressive members, as well as tensile members to which the former are connected by appropriately designed connectors of the type 2 and 21, all of which take part in this mechanism.

Generally, more than one such buckling mechanism or mode, involving the developed buckling of different sets of initially critically stressed compressive members, may develop from the initial or incipient critical state in a quasi-hinged (as if hinged) lattice or truss. This is well known and generally established not only by theory. The explanation why numerous different post-buckling mechanisms may develop one at the time, from the critical state is found in the choice of geometrical configurations each initially critically stressed compressive member can take in this buckling process. Such a member may either buckle out flexurally as shown in FIG. 10*b*, under an increasing axial force and two equal restraining moments of opposite signs, concentrated at the plastic hinges forming in the necks 6 of the two end-connectors 2 and 21 assembled as in FIG. 2, or it remains almost straight or bending very slightly elastically in double curvature and rotating bodily about these hinges, as shown in FIG. 10*c*. This happens under a more or less constant critical axial load and two nearly equal small restraining moments of the same sign concentrated at these plastic hinges, as the joints to which the member is connected are displaced relative to each other (in FIG. 10 indicated by the amount (Δ) in the developing post-buckling mechanism. In this process, the resultant end-forces, acting on the connector pin between the adjacent nodal sphere 30 and the plastic hinge at neck 6, may be eccentric, as indicated in FIG. 10*c*. These relative displacements of the joints occur throughout that part of the lattice in which the buckling of compressive members fully develops. A similar type of bodily rotation, about the plastic hinges forming in the necks 6 of their respective connector pins occurs also in those tensile members which participate in this mechanism, as indicated in FIG. 10*d*. These members remain practically straight under tensile axial forces and small plastic end-moments. The necked-down portions 5, 6, 7 in the connectors of these tensile members are so designed, that plastic yielding and the formation of the plastic hinges can develop in the required post-buckling mode or mechanism of which they are a part. Plastic hinges and the corresponding rotations in the necked-down portions 6 of the connectors of tensile members develop under slightly eccentric tensile forces acting at the member ends as indicated in FIG. 10*d*. (These eccentricities are then approximately equal to ($\Delta$), i.e. in this case twice the amount of the plastic moment (M) divided by the magnitude ($T_c$) of the axial tensile load in the member, evaluated in the initial or incipient critical state of the structure.)

If an initially critically stressed compressive member, participating in a buckling mechanism, were ideally hinged at its ends and it did not buckle but remained straight in this post-buckling mechanism, its axial load would have to decrease, because only under a subcritical axial load can such member be maintained in a straight configuration, while the external loads acting on the lattice causing this mechanism to develop in equilibrium, might increase or decrease. On the other hand, if such a member were constrained by plastic hinges at its ends, its axial load would not decrease appreciably or it may even have to be slightly increased. This issue is settled partly by the overall equilibrium conditions of the structure under which a buckling mechanism, involving the formation of plastic hinges in the connectors of the participating members, can develop, or by the laws of dynamics, if this mechanism is permitted to develop in a dynamic collapse, and partly by the interaction between the plastic restraining moment acting in the neck of such a connector and the instantaneous value of the axial load in this neck. This interaction may be quantitatively summarized by the curve in the diagram in FIG. 10*e*, which represents the relationship of the plastic moment (M) and the axial load (P) at the neck 6 of a typical connector necessary for a plastic hinge to fully develop. The chart is plotted in a non-dimensional form of the ratios ($M/M_p$), where ($M_p$) is the full plastic moment at no axial load in the neck 6, and ($P/P_y$), where ($P_y$) is the first yield load in the neck 6 without any bending moment. For small values of (M/Mp), full plastic yielding in this hinge rotation occurs along the curve shown in the diagram. This curve has an inclined tangent at the point where ($P=P_y$) and ($M=0$), or where (M) is small. As (M) increases from zero on this curve, the axial load (P), making this hinge rotation possible, increases slightly above the initial critical value ($P_o$) of the load in the region of ($P_y$). Therefore, the critical value of the external load parameter, necessary for this and other plastic hinges to develop, may have to be increased beyond that value, which would be required for the same buckling mechanism to develop, if this and other participating members were ideally hinged. It follows from this, that the real structure in which these plastic hinges develop could at least safely carry that same set of external critical loads, under which it would buckle, if its members were not plastically but ideally hinged. The experimental relationship between the axial load and the local plastic rotation at the connector neck 6 and the overall deformation of such a member, is described more fully hereinafter.

Therefore, essential for the principle of the plastic hinge to work in the development of an actual post-buckling mode or mechanism is the available potential for its formation in the critical state of loading. This potential is embedded in the design of the necked-down portions 5, 6, and 7 of the connector pins. In a practical case, the structure would be designed for this critical value of the external load parameter divided by a factor of safety and the plastic hinges would, in reality, never develop.

So, the essential function of each connector pin is to provide this potential in order that a plastic hinge may indeed form, if the buckling mechanism were to develop so that, beyond the critical state, the members may either buckle or participate in the buckling mechanism by merely rotating in space about the yield connector necks 6 at their ends.

If the lattice is so designed, that the buckling mechanism develops only within a local region and the remainder of the lattice participates in this mechanism only as a rigid body pivoting about the peripheral plastic hinges of this region, then the members in the solid or rigid part of the lattice need not develop rotations about the necked-down portions 6 of their connectors. In such a case it may be desirable to stiffen the connector necks 6 accordingly, and such rotations may be prevented as required. Other instances, in which it may be desirable or necessary to stiffen the connector necks 6 in certain members to avoid the formation of plastic hinges, thus preventing these members from buckling, are given in a subsequent section dealing with the application of the theory utilizing the concepts and the technical devices of the connector pins described in this section. This may be especially relevant in designing the lattice to develop a favorable buckling mechanism, resulting in an optimal structural response.

Thus, the special connectors 2 or 21 described before are serving the dual purpose of connecting the members of the type 1 and 1*a*, FIGS. 1, 2, 3, 4 to the nodal spheres 30 and ensuring the formation of localized rotations in the plastically yielding necked-down portions 6 in the critical state, so that, in this state, the system acquires the potential to buckle as a quasi-hinged (as if hinged) space truss in one of the physically possible buckling mechanisms.

The special connectors of the type 2 or 21 embody a further mechanical function or property in that they permit a shortening or a lengthening of assembled members of the type 28, FIG. 2, and exposed lengths of connector pins in the end fittings in the assembled lattice. This function is of paramount importance, as it makes the adjustments and the fitting of the lattice in the erection state to its prescribed geometry readily possible. This is accomplished by loosening the locking nuts 10, 11, 19 and 20, FIG. 2 and simultaneously applying spanners to the hexagonal (or square) parts 13 of the opposite sleeves or bushings 12 and 16 and turning these bushings and the connecting tube 15 (or a solid assembled member shown in FIGS. 3 and 4) in a counterclockwise direction, as the case may be.

These connectors also make the insertion and the removal of all members into and from the assembled lattice between any two fixed nodes readily feasible, without affecting the alignment of its geometry.

These removals or insertions between two fixed nodal spheres 3 are accomplished as follows: referring to FIG. 2, the removal of the assembled member 28 from the nodal spheres 30 of the neighboring joints, without changing the locations of these nodes in any way, i.e. by keeping the distance 41 constant is carried out by releasing the locking nuts 10, 11, 19 and 20 and slipping the locking nuts 10 and 20 to the adjacent necked-down portions 6, while the nuts 11 and 19 are left on the dorsal threads 9 and 21 respectively, protruding over the portions 8. This operation exposes sufficient lengths of the dorsal threads 9 and 22 for the connector bolts to penetrate in the holes 14 and 18 respectively. Alternatively, both locking nuts may be slipped over to the adjacent necked-down portions 6, the nuts 11 and 19 covering only a minor part of the hexagons 8. Then, first say the connector pin 2 is unscrewed by applying a spanner to the exposed hexagon 8, so that it advances into the threaded hole 14 of the bushing 12, until a sufficient gap is created between the tip of the frontal thread 3 and the nodal sphere 30. This operation is repeated by applying the spanner to the opposite hexagon 8 and turning the opposite connector pin 21 in the sense opposite to that in which the pin 2 was turned, thereby letting the dorsal thread 22 advance into the threaded hole 18 of the opposite bushing 18, until a sufficient gap is created between the opposite tip of the frontal thread 23 and its adjacent nodal sphere 30, so that the shortened member 28 may be taken out without displacing in any way the two neighboring nodal spheres 30.

The insertion of such a member proceeds in exactly the same but inverse sequence, so that a member in the assembled lattice may be replaced without affecting the alignment of the assembled structure.

If the member is solid, such as that shown in FIG. 3, or if only one locking nut is used at each end, the procedure for the removal or insertion is identical. In the case of a solid bar only, the depths of the threads 26 and 27 and of their holes must be sufficient to absorb the dorsal threads 9 and 22 respectively, so as to create sufficient clearances between the tips of the frontal threads 3 and 23 and their adjacent nodal spheres 30. In this way the assembled member 1*a* may be removed or inserted between them without interference.

It follows from the description of these types of systems that, any member connected by these specially designed connectors in which the local plastic hinges may be formed in the necks 6 in the ultimate critical state of a particular system of which the member is a part, can be considered as being actually hinged in that state and in the states beyond, characterized by the development of a post-buckling mechanism, in which the deformations of the members are finite and elastic except at the plastic hinges. By this device, the entire lattice becomes quasi hinge-connected, i.e. as if actually hinged at the nodes, in an actual critical and the ensuing post-critical states, in which it can be considered as a virtually hinged or pin-jointed space truss or space lattice and it may be analyzed, designed and optimized accordingly. In other words, all the methods of analysis, design and structural optimization of such structures and their advantages now apply directly to this quasi pin-jointed system fitted with these special connectors.

EXAMPLE 1

Figure 12:
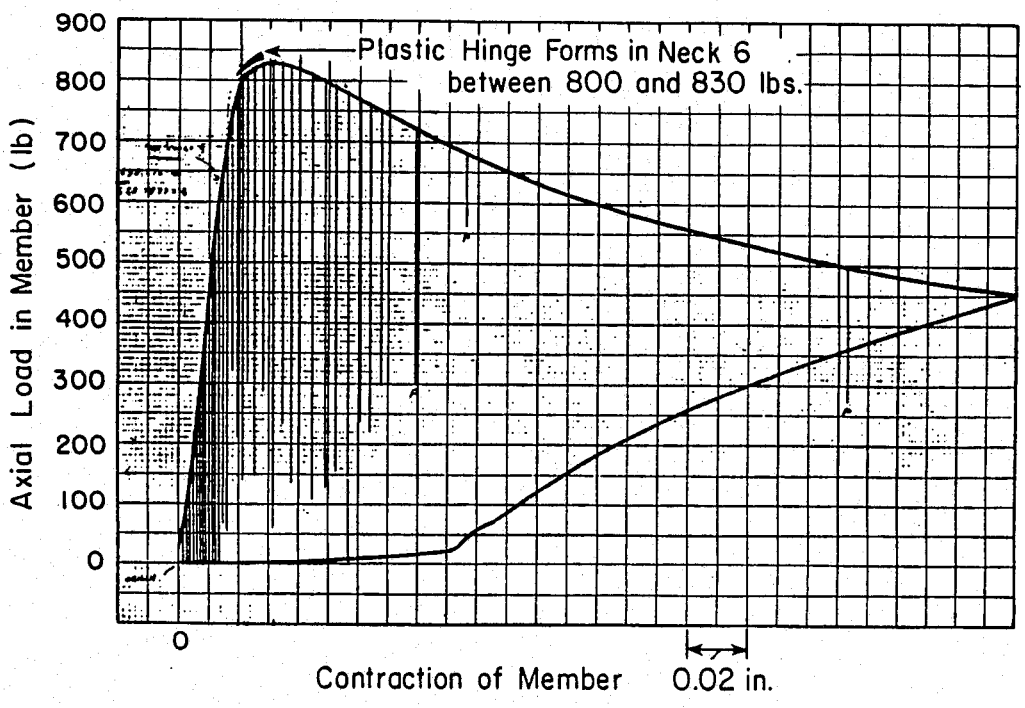
FIG. 12 is a graphic representation of the contraction under load of a given structural element under test, fitted with the connectors of the present invention, and the formation of the plastic hinges in the connector necks.
Figure 12A:
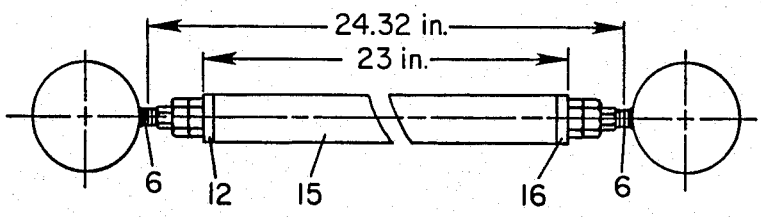
FIG. 12*a* shows the tubular member 24.32 inches long 9/16 inches in outside diameter and 0.020 inches thick with neck 6 of ⅛ inches in diameter and ¼ inches in length used in the test described in Example 1 and characterized in FIG. 12.
Figure 13:
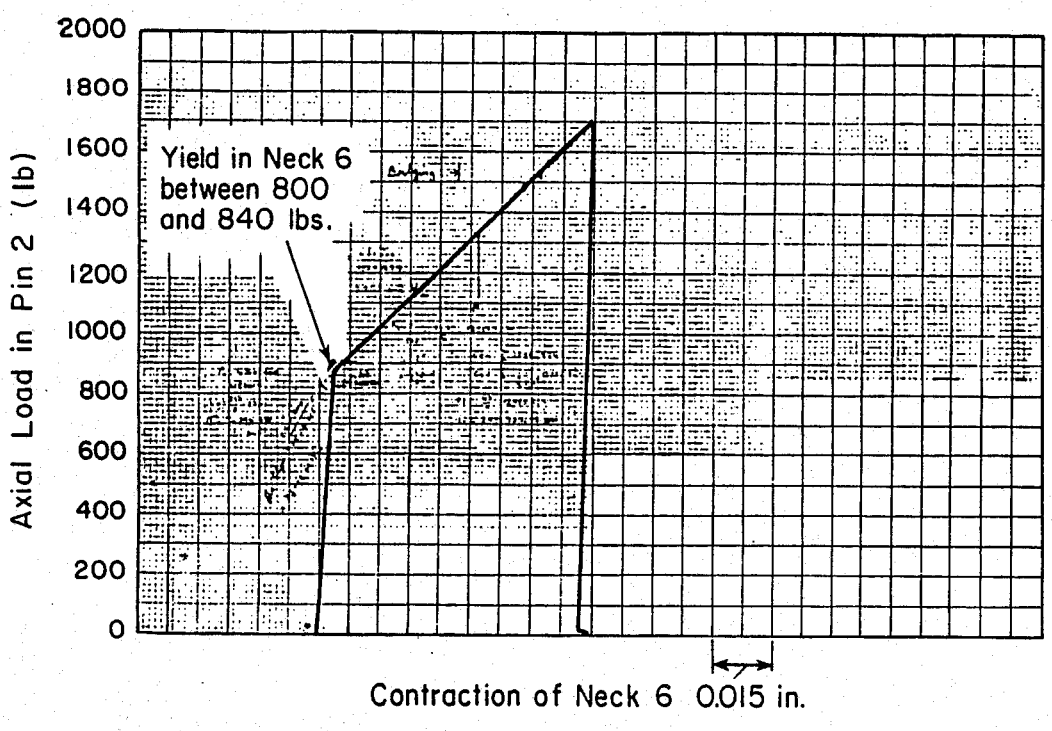
FIG. 13 is a graphic representation of the contraction under a uniaxial load of the necked-down portion of a typical connector of the present invention under test.
Figure 13A:
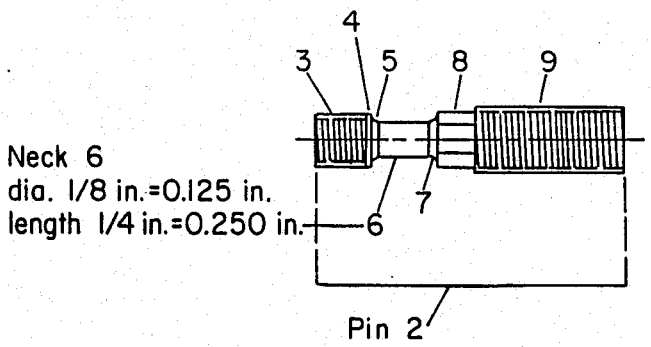
FIG. 13*a* shows the connector pin 2 with neck 6 of ⅛ inches in diameter and ¼ inches in length used in the test described in Example 1 and characterized in FIG. 13.
Figure 14:
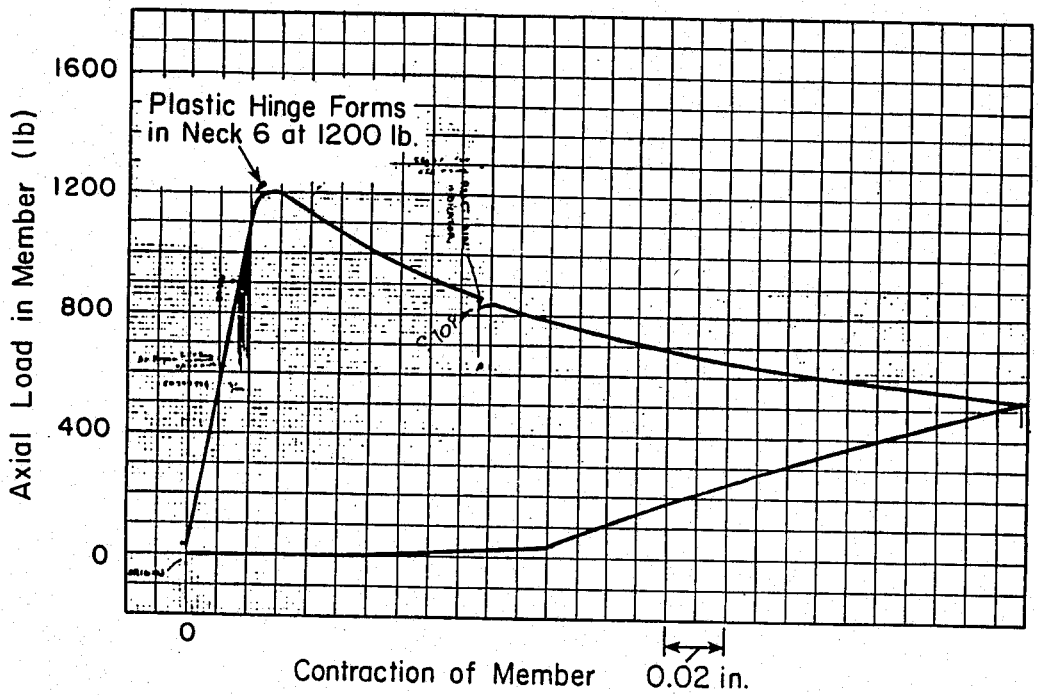
FIGS. 14 to 19 are graphic representations of contractions under load of given structural elements under test, fitted with the connectors of the present invention, and the formation of the plastic hinges in the connector necks.
Figure 14A:
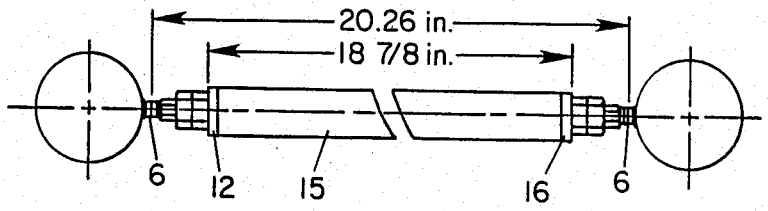
FIG. 14*a* shows the tubular member 20.26 inches long 9/16 inches in outside diameter and 0.020 inches thick, used in the test described in Example 2 and characterized in FIG. 14.
Figure 14B:
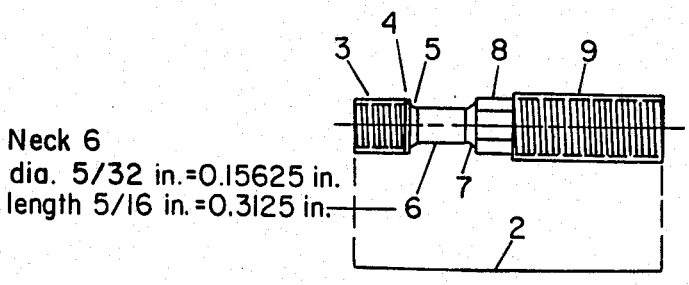
FIG. 14*b* shows the connector pin 2 with neck 6 of 5/32 inches in diameter and 5/16 inches in length used in the test described in Example 2 and characterized in FIG. 14.

A test was carried out on a tubular member, shown in FIG. 1, in compression. The member length between the center of the opposite necks 6 was 24.32 in. and the length of the tube 15 with the sleeves 12 and 16 attached was 23 in. The tube thickness was 0.020 in. and its outside diameter, 9/16 inches, FIG. 12. The connector pins were of the type 2 with the neck size 6 of ⅛ in. diameter and ¼ in. in length, as shown in FIG. 13. (The member was somewhat longer, but otherwise similar to that shown in FIG. 14 of Example 2.)

The axial load - contraction diagram (FIG. 12) for the member in compression is linear up to approximately 770 lb. of axial load, when yielding in the neck 6 begins and the plastic hinges form in the necks 6 of both end-connectors between 770 lb. and 830 lb. of axial load. After, the development of the plastic hinges, the load gradually decreases, as indicated in the diagram of FIG. 12. A decrease in axial load is a consequence of the flexural plastification of the neck 6, resulting in a plastic hinge.

FIG. 13 shows the graph of the axial load against the axial contraction of the neck 6 of the connector pin 2 for the specimen in FIG. 1, which was tested separately in a specially prepared jig. This test verifies the onset of pronounced yielding in the neck 6 at the axial load of 830 to approximately 880 lb., which falls into the same region of loading as in the curve in FIG. 12, when the same connector pins were attached to the member 2.

Figure 11:
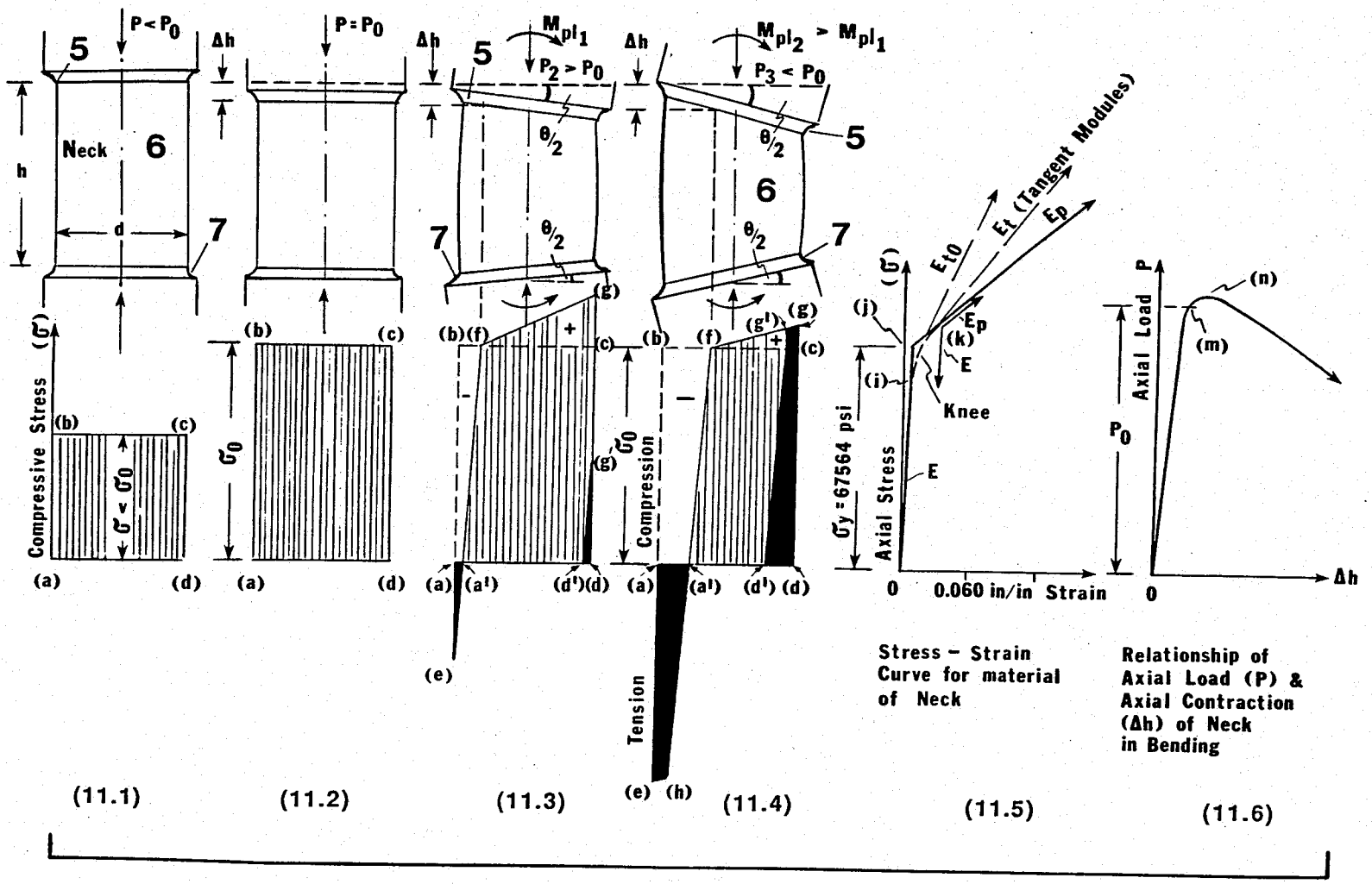
FIG. 11 shows schematic representations of the formation of the plastic hinge in the connector of the present invention under an axial load and a bending moment.

The diagram in FIG. 13 may be reduced to a stress-strain diagram with a rounded knee at the point of yielding, as indicated in FIG. 11.5. Before this knee is reached on the stress-strain curve, the tangent of this curve is the elastic modulus E (for steel $E=29.5\times10^6$ psi). Around the knee this tangent modulus is reduced from its elastic value to that characterized by the plastic strain-hardening of the material. For the stainless steel used in these experiments this plastic strain-hardening modulus $E_p$ was found to be approximately equal to $0.267612\times10^6$ psi. So around this knee the tangent modulus is reduced from its elastic value of approximately $29.5\times10^6$ psi to a mere $0.267612\times10^6$ psi. (The last value was obtained by averages obtained from several tests and for different pin sizes.)

The test depicted in FIG. 12, shows that the onset of plastic yielding in the neck 6 is followed at first by a slight increase in the axial load before this load begins to decrease. The rate at which this increase occurs and the size of the knee of the buckling curve in FIG. 12, depends on the ratio of the plastic stiffness of the neck 6 and the elastic stiffness of the tube. This ratio is defined as $$r = \frac{E_t I_p}{h} \Big/ \frac{EI}{L} = \frac{\pi d^4 E_t L}{64\,EIh} \qquad 1$$

where:

$E_t$—tangent modulus on the plastic stress-strain curve $E_{to}$—initial tangent modulus at which plastic yielding in the neck 6 and elastic buckling of the member begin h—length of neck 6 d—diameter of neck 6

$I_p$—moment of inertia of cross-sectional area of neck 6 ($I_p=\pi d^4/64$)

E—elastic modulus of member tube 15

L—effective buckling length of member between the centers of the opposite neck 6 (opposite plastic hinges)

I—moment of inertia of the cross-sectional area of elastic member (tube) (or solid rod)

Therefore, when *plastic yielding* in the neck 6 *begins*

$$r = r_o = \frac{E_{to} I_p}{h} \Big/ \frac{EI}{L} = \frac{\pi d^4 E_{to} L}{64\,EIh} \qquad 2$$

and, when the *hinge* in neck 6 is *fully developed*

$$r = r_p = \frac{E_p I_p}{h} / \frac{EI}{L} = \frac{\pi d^4 E_p L}{64\, EIh} \quad (3)$$

where, for the material used in the tests, the plastic strain hardening modulus $E_p = 0.267612 \times 10^6$ psi.

For the specimen in Example 1 $d = \frac{1}{8}$ in., $h = \frac{1}{4}$ in., $L = 24.32$ in., $E = 29.5 \times 10^6$ psi and $I = 0.00125568$ in$^4$. This gives $$r = r_p = \frac{12.8285 \text{ lb in}}{1523.1316 \text{ lb in}} = 0.00842244 \quad (4)$$

The value of ($E_{to}$) and of ($r_o$) depend on the axial load in the member to which the connector pins with the neck 6 are attached.

It can be shown from theory that the onset of plastic yielding in the cylindrical neck 6 and the onset of elastic buckling of the member (elastic tube or elastic rod) are governed by the following equation.

$$r_o = \frac{E_{to} I_p}{h} / \frac{EI}{L} = -\sqrt{p_o} \cot \tfrac{1}{2} \sqrt{p_o} \quad (5)$$

or $$r_o = \frac{\pi d^4 E_{to} L}{64 EIh} = -\sqrt{p_o} \cot \tfrac{1}{2} \sqrt{p_o} \quad (5a)$$

where $$p_o = \frac{p_o L^2}{EI} \quad (5b)$$

and, where, ($P_o$) is the value of the axial load P in the member at which buckling of the member begins. In the test of FIG. 12, Example 1 ($P_o = 770$ lb) approximately. For this test, then $$P_o = \frac{P_o L^2}{EI} = 12.29466992 \quad (6)$$

and $$r_o = \frac{\pi d^4 E_{to} L}{64 EIh} = -\sqrt{12.29466992} \cot \tfrac{1}{2} \sqrt{12.29466992}$$

or $$r_o = \frac{\pi d^4 E_{to} L}{64 EIh} = 0.646720393 \quad (6a)$$

and $$E_{to} = \frac{64 EIh}{\pi d^4 L} 0.646720393 = 20.54868506 \times 10^6 \text{ psi} \quad (6b)$$

as opposed to the elastic modulus $E = 29.5 \times 10^6$ psi. When $E_{to} = 0$, it follows from Eq. 5a that $$\cot \tfrac{1}{2} \sqrt{\frac{P_o L^2}{EI}} = 0 \quad (7)$$

or that

-continued $$\tfrac{1}{2} \sqrt{\frac{P_o L^2}{EI}} = \frac{\pi}{2}$$

This gives $$P_o = \frac{\pi^2 EI}{L^2} = P_E$$

which is the well known Euler load.

In general ($P_o$) may be written, $$P_O = k \frac{\pi^2 EI}{L^2} \text{ or } p_o = k\pi^2 \quad (8)$$

where k represents the plastic restraint of the opposite pins (necks 6) to the flexural buckling of the member. Then Eq. 5a reduces to, $$r_o = \frac{E_{to} I_p}{h} / \frac{EI}{L} = -\pi \sqrt{k} \cot \frac{\pi}{2} \sqrt{k} \quad (9)$$

For the case of the specimen in the test of Example 1, according to Eqs, 6 and 8, $$\sqrt{k} = \frac{\sqrt{12.29466992}}{\pi} = 1.11611402 \quad (10)$$

and $$k = 1.2457105 \quad (10a)$$

The increase in k from that for a real hinge when ($k = 1.0$) is in this case 0.2457105. This represents the increase in the initial buckling load of this member under the plastic restraints in the necks 6 of the connector pins by virtue of their plastic yielding, and the subsequent formation of the plastic hinge, compared to the Euler load for the same member, if this member were connected by real hinges.

The characteristic ratio (d/h) of the diameter of neck 6 and its length is $$d/h = \tfrac{1}{2} = 0.50 \quad (10b)$$

The elastic stiffness of the member in this case is $$\frac{EI}{L} = \frac{29.5\ 10^6\ 0.00125568}{24.32} = 1523.13 \text{ lb in} \quad (10c)$$

and the plastic stiffness of the connector pin (neck 6) is $$\frac{E_{to} I_p}{h} = \frac{\pi d^4 E_{to}}{64 h} = \frac{\pi (\tfrac{1}{8})^4\ 20.548685\ 10^6}{64 \tfrac{1}{4}} = 985.04 \text{ lb in.} \quad (10d)$$

This suggest a relatively large stiffness of the pins, compared to the stiffness of the member.

EXAMPLE 2

The tubular member tested in compression is now shorter (20.26 in.) and, therefore, the elastic stiffness of the member EI/L is now larger, i.e.

$$\frac{EI}{L} = \frac{29.5 \times 10^6 \times 0.00125568}{20.26} = 1828.3594 \text{ lb in} \quad 11$$

as opposed to 1523.1216 lb. in. in Example 1. The diameter of the neck is also slightly larger (d=5/32 in.), as opposed to (⅛ in.) in Example 1. The characteristic ratio (d/h) of the neck is the same as before and equal to 0.5. Noting that the horizontal scales in the diagrams are the same, it is apparent, that the knee of the buckling curve is now less rounded and the *plastic hinge is formed more rapidly.* This is enhanced by the larger stiffness of the elastic member (tube).

The onsets of the plastic yielding and elastic buckling occur at approximately $P_o$=1,180 lb. Also $$P_o = \frac{P_o L^2}{EI} = \frac{1180\ 20.26^2}{29.5\ 10^6\ 0.00125568} = 13.0755479 \quad 11a$$

The ratio $r_o$, defined by Eq. 2, can be calculated from Eq. 5a, using the above value for $p_o$. Then $$r_o = \frac{E_{to} I_p}{h} \Big/ \frac{EI}{L} = \frac{\pi d^4 E_{to} L}{64 EIh} = \quad 12$$

$$-\sqrt{13.0755479}\ \cot\tfrac{1}{2}\sqrt{13.0755479}$$

$$r_o = \frac{E_{to} I_p}{h} \Big/ \frac{EI}{L} = \frac{\pi d^4 E_{to} L}{64 EIh} = 0.874213234$$

Hence, $$E_{to} = \frac{64 EIh}{\pi d^4 L}\ 0.874213234 \quad 12a$$

or $$E_{to} = \frac{64\ 29.5\ 10^6\ 0.00125568\ (5/16)}{\pi (5/32)^4\ 20.26}\ 0.874213234$$

$$= 17.07178558\ 10^6 \text{ psi}$$

$E_{to}$ is now somewhat smaller. This means that the yielding in the neck occurs a little further along the knee shown in FIG. 13, on the stress strain curve, for the fibers of the material of the neck and so, the reduction of the tangent modulus $E_t$ in the neck 6 progresses faster with the formation of the plastic hinge.

In this case the neck is slightly thicker and it offers a slightly larger plastic restraint which is reflected in a slightly higher value of the constant k.

Now $$\sqrt{k} = \frac{\sqrt{13.0755479}}{\pi} = 1.1510126 \quad 13$$

and $$k = 1.32482999$$

The increase in k from unity (the value for a real hinge) is now 0.3248300 as opposed to 0.2457105 in the last example.

The ratio d/h of the diameter neck 6 to its length is again $$d/h = \tfrac{1}{2} = 0.50 \quad 14$$

The plastic stiffness of the pin when the specimen member is on the point of buckling is $$\frac{E_{to} I_p}{h} = \frac{\pi d^4 E_{to}}{64\ h} = \frac{\pi (5/32)^4\ 17.07178558\ 10^6}{64\ (5/16)} = 1{,}598.376 \text{ lb in}$$

EXAMPLE 3

Figure 15:
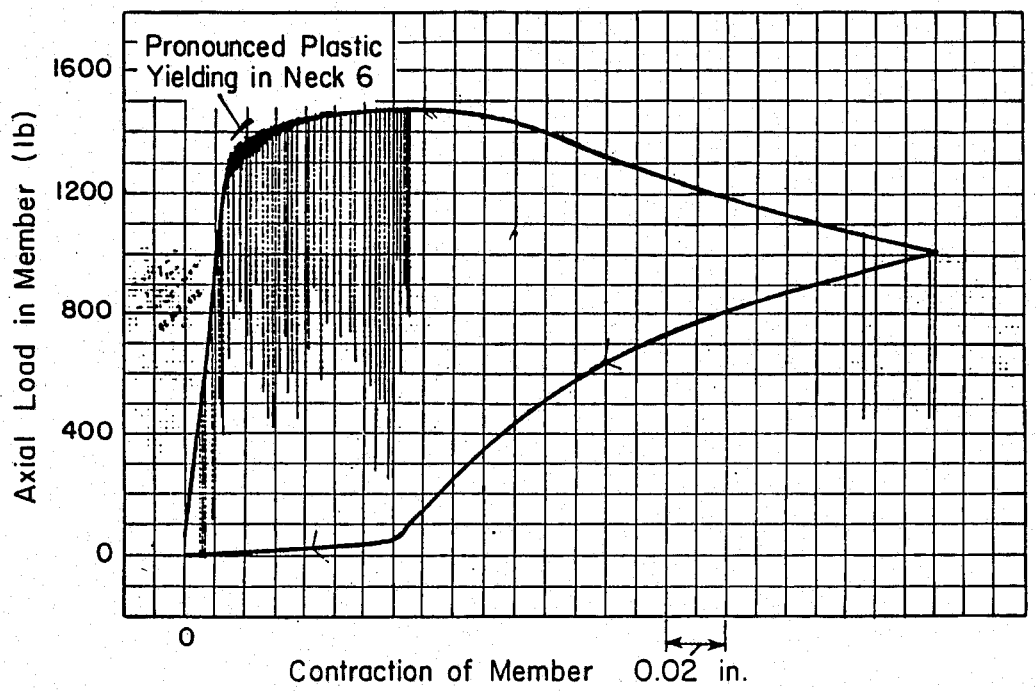
Figure 15A:
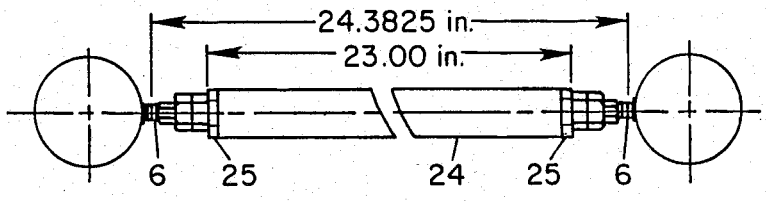
FIG. 15*a* shows the solid member 24.3825 inches long and ½ inches in diameter used in the test described in Example 3 and characterized in FIG. 15.
Figure 15B:
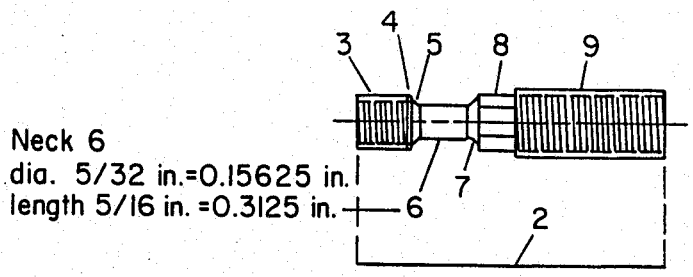
FIG. 15*b* shows the connector pin 2 with neck 6 of 5/32 inches in diameter and 5/16 inches in length used in the test described in Example 3 and characterized in FIG. 15.

In FIG. 15, the diagram shows the relationship between the axial load and the overall contraction of a solid member tested in compression. The stiffness of this member is larger than in the previous two cases of tubular members, i.e.

$$\frac{EI}{L} = \frac{29.5\ 10^6\ 0.003067962}{24.3825} = 3711.8780 \text{ lb in} \quad 15$$

The diameter of the neck 6 is now 5/32 in. and its length 6/16 in. Its characteristic ratio $$d/h = \tfrac{1}{2} = 0.50 \quad 15a$$

In this case the necks 6 are so designed that pronounced plastic yielding takes place in the neck, before buckling of the member occurs under the plastic restraint of the connector pins, as demonstrated by the flattened portion of the curve in FIG. 15.

In this case, buckling begins at approximately $P_o$=1,500 lb. This gives, with I=0.003067962 in$^4$, $$P_o = \frac{P_o L^2}{EI} = \frac{1500 \times 24.3825^2}{29.5\ 10^6\ 0.003067962} = 9.853164 \quad 16$$

and, $$k = \frac{9.853164}{\pi^2} = 0.998 = 1.00 \quad 17$$

This means the plastification in the neck 6 has progressed faster than in the previous tests and the plastic hinge behaves almost as a real hinge, since now k is practically equal to unity and $$r_o = \frac{E_{to} I_p}{h} \Big/ \frac{EI}{L} = \text{zero.} \quad 18$$

Figure 16:
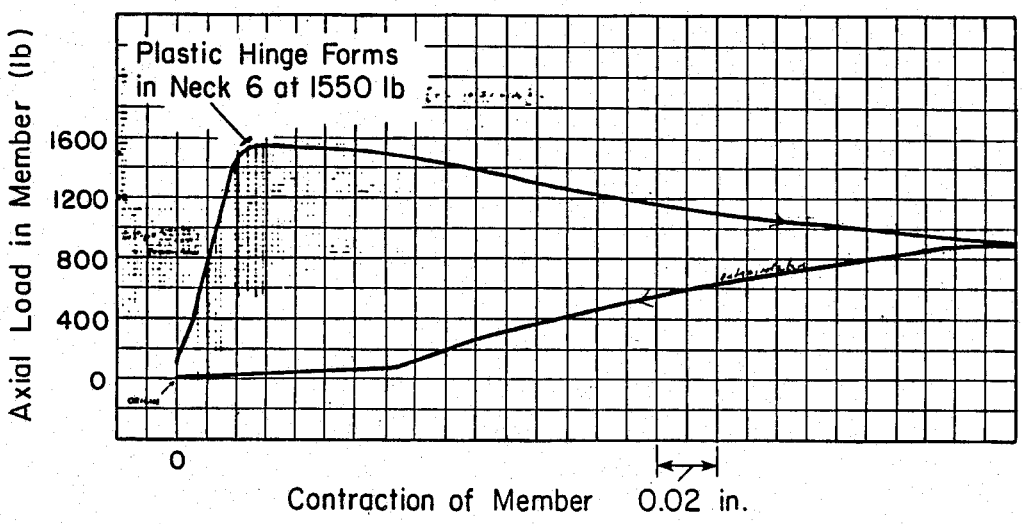
Figure 16A:
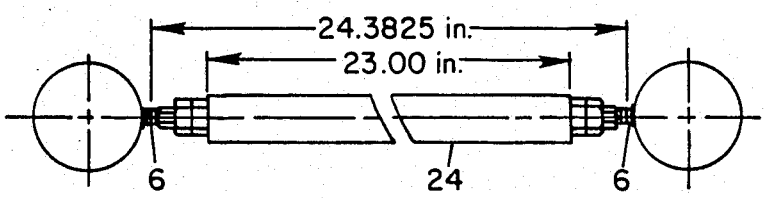
FIG. 16*a* shows the solid member 24.3825 inches long and ½ inches in diameter used in the test described in Example 3 and characterized in FIG. 16.
Figure 16B:
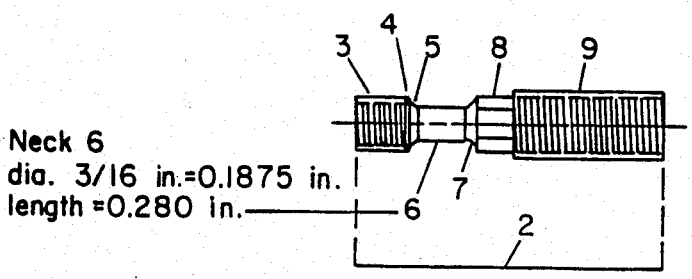
FIG. 16*b* shows the connector pin 2 with neck 6 of 3/16 inches in diameter and 0.280 inches in length used in the test described in Example 3 and characterized in FIG. 16.

In FIG. 16, the same solid rod of ½ in. diameter was connected by a stronger pin with a neck size 6 of 3/16 inches diameter 0.0280 inches long. Now, buckling is observed to develop at approximately $P_o$=1,550 lb. This makes the value of k slightly larger, i.e.

$$P_o = \frac{1550\ 24.3875^2}{29.5\ 10^6\ 0.003067962} = 10.181603 \quad 19$$

and $$k = \frac{10.181603}{\pi^2} = 1.03162097 \quad 20$$

k is only slightly larger than unity and the buckling curve is therefore flat, as the plastic hinges in the necks 6 of the pins offer little plastic restraint to the buckling of the member under a slightly stiffer neck 6, its characteristic ratio being $$d/h = 0.670 \quad 20a$$

In this case, $$r_o = \frac{E_{to}I_p}{h} / \frac{EI}{L} = \frac{\pi d^4 E_{to} L}{64\, EIh} = 0.078622435 \quad (21)$$

and $$E_{to} = \frac{64\ 29.5\ 10^6\ 0.003067962\ 0.280}{\pi 0.1875^4\ 24.3825}\ 0.078622435 \quad (22)$$

$$= 1.346863\ 10^6 \text{ psi}$$

which means that the plastification in the necks has progressed a long way before buckling of the rod began and the tangent modulus $E_t$ at the point of buckling of the rod is reduced considerably along the stress-strain curve from $29.5\times10^6$ psi to a mere $1.346863\times10^6$ psi, almost to the point of uniform strain hardening, where the tangent modulus $E_t$ equals to $E_p=0.267612\times10^6$ psi, as shown in Example 1. The plastic stiffness of the pin is now only $$\frac{E_{to}I_p}{h} = \frac{\pi d^4 E_{to}}{64\, h} = \frac{\pi(3/16)^4\ 1.346863\ 10^6}{64\ 0.280} = 291.8370 \text{ lb in} \quad (22a)$$

EXAMPLE 4

Figure 17:
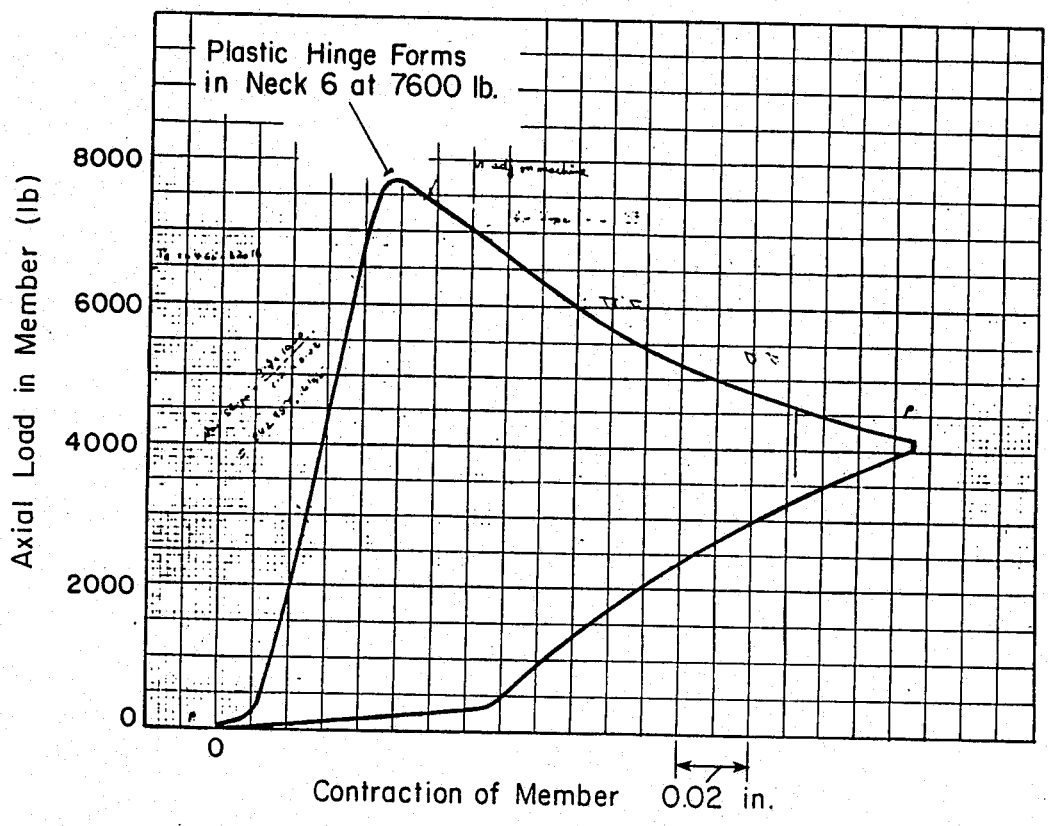
Figure 17A:
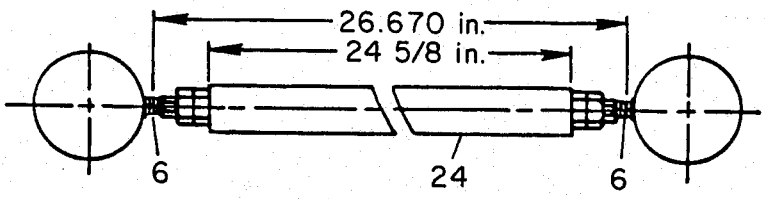
FIG. 17*a* shows the solid member 26.670 inches long and ¾ inches in diameter used in Test 1 described in Example 4 and characterized in FIG. 17.
Figure 17B:
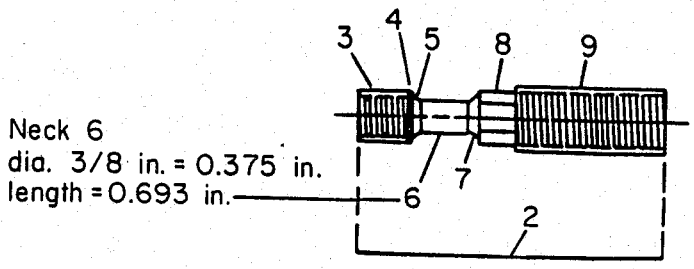
FIG. 17*b* shows the connector pin 2 with neck 6 of ⅜ inches in diameter and 0.693 inches in length used in Test 1 described in Example 4 and characterized in FIG. 17.
Figure 18:
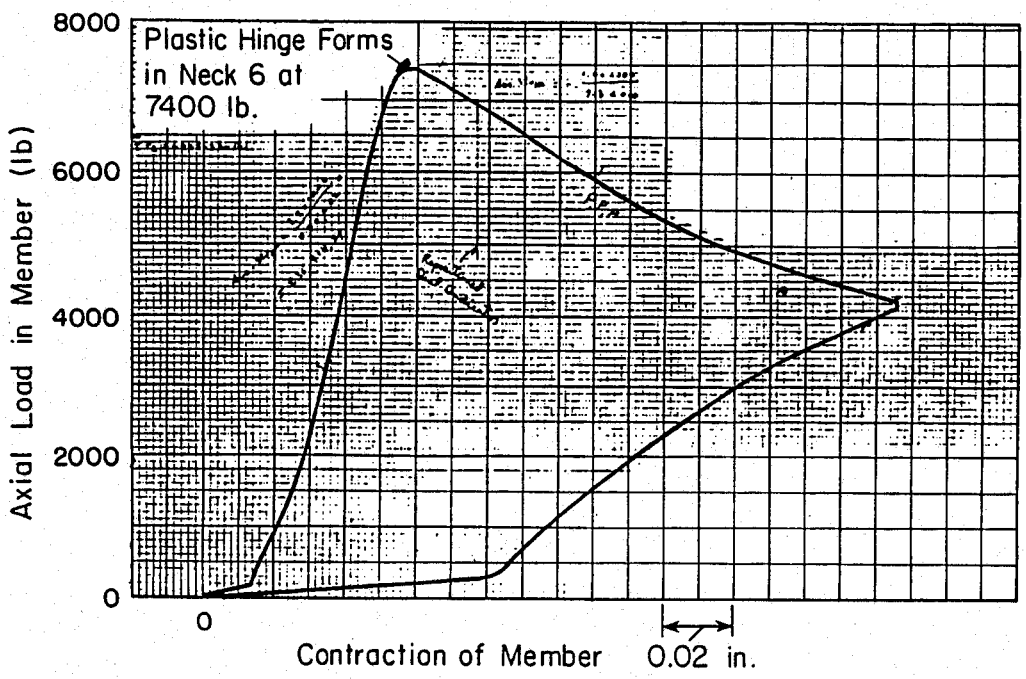
Figure 18A:
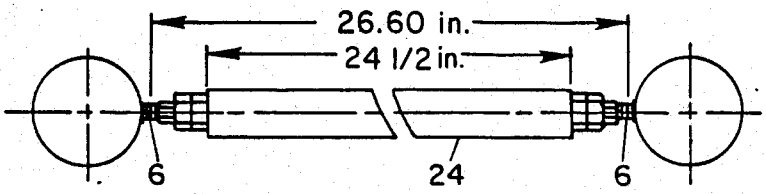
FIG. 18*a* shows the solid member 26.73 inches long and ¾ inches in diameter used in Test 2 described in Example 4 and characterized in FIG. 18.
Figure 18B:
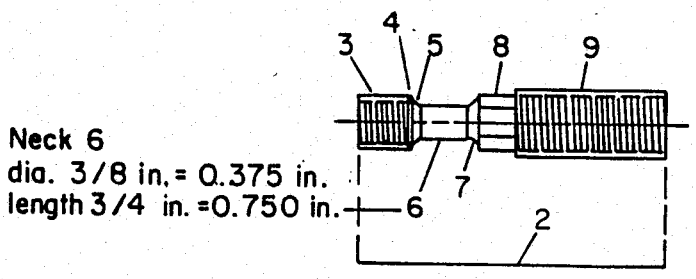
FIG. 18*b* shows the connector pin 2 with neck 6 of ⅜ inches in diamter and ¾ inches in length used in Test 2 described in Example 4 and characterized in FIG. 18.

Two solid members of practically the same lengths and rod diameters of $\frac{3}{4}$ inches, connected by pins of slightly different neck-lengths 6, tested in compression, are compared in this example. The experimental curves in FIGS. 17 and 18 represent the axial load-contraction relationships for the specimens.

The neck 6 of the connector pin for the specimen in the test 1 of this Example has a diameter of $\frac{3}{8}$ inches and the neck-length is 0.693 inches. The neck 6 of the solid member in the second test in this Example, has the same diameter of $\frac{3}{8}$ inches as that in test 1, but it is slightly longer, its length being 0.75 inches. Thus, the diameter to length ratios of the necks 6 of the connector pins in the two tests are:

$$\text{Test (1): } d/h = \frac{0.375}{0.693} = 0.541 \quad (23a)$$

$$\text{Test (2): } d/h = \frac{0.375}{0.750} = 0.50 \quad (23b)$$

The elastic stiffnesses of the two members are now:

$$\text{Test (1): } \frac{EI}{L} = \frac{29.5\ 10^6\ 0.015531555}{26.670} = 17{,}179.64 \text{ lb in} \quad (24a)$$

$$\text{Test (2): } \frac{EI}{L} = \frac{29.5\ 10^6\ 0.015531555}{26.60} = 17{,}224.84 \text{ lb in} \quad (24b)$$

Thus, the specimen member in Test 2 is slightly stiffer.

In this test, the effect of a slight change in the characteristic ratio of (d/h) for the neck 6 on the buckling load and on the formation of the plastic hinges in the necked-down regions 6 of the connector pins is tested.

The curve in FIG. 18 shows that a slightly lower ratio of ($d/h=0.5$) results in a slightly lower buckling (peak) load of 7400 lbs. compared to that obtained in test 1, FIG. 17, where this load was approximately 7600 to 7700 lbs. and the neck ratio 0.541. A shorter neck 6 of the same diameter, therefore, offers a slightly greater resistance or restraint to the initial buckling of the member.

The initial buckling loads and the plastic restraining constants (k) of the connector pins in these two may be estimated as follows:

Test 1:

$$p_o = 7600 \text{ lb.} \quad (25)$$

$$p_o = \frac{p_o L^2}{EI} = \frac{7600\ 26.67^2}{29.5\ 10^6\ 0.015531555} = 11.7983878 \quad (25a)$$

$$k = \frac{11.7983878}{\pi^2} = 1.1954266 \quad (26)$$

Test 2:

$$p_o = 7400 \text{ lb.} \quad (27)$$

$$p_o = \frac{p_o L^2}{EI} = \frac{7400\ 26.60^2}{29.5\ 10^6\ 0.015531555} = 11.4276791 \quad (27a)$$

$$k = \frac{11.4276791}{\pi^2} = 1.1578660 \quad (28)$$

These values of (k) are relatively smaller than that for the specimen in Example 1, for instance, and therefore, the connector pins in their necks 6 in this case offer less resistance (smaller plastic restraints) to the buckling process in the members. Plastic hinges are formed in these necks faster, as comparison of the buckling curves in this example and example 1 indicates.

The ratios ($r_o$) of the pin-to-rod stiffnesses and the initial plastic modulii ($E_{to}$) for the two tests may be estimated as follows:

Test 1:

$$r_o = \frac{E_{to}I_p}{h} / \frac{EI}{L} = \frac{\pi d^4 E_{to} L}{64EIh} = -\sqrt{p_o}\cot\tfrac{1}{2}\sqrt{p_o} \quad (29)$$

using the result of Eq. (25a) for ($p_o$), $$r_o = \frac{\pi d^4 E_{to} L}{64EIh} = 0.5073418 \quad (30)$$

and $$E_{to} = \frac{64\ 29.5\ 10^6\ 0.015531555\ 0.693}{\pi(\frac{3}{8})^4\ 26.670}\ 0.5073418 \quad (31)$$

$$= 6.\ 222\ 327\ 10^6 \text{ psi}$$

Test 2:

Using Eq. 29 with the data for the specimen in test (2) and substituting for ($p_o$) from Eq. (27a)

$$r_o = \frac{\pi d^4 E_{to} L}{64EIh} = 0.405717417 \quad (32)$$

and $$E_{to} = \frac{64\ 29.5\ 10^6\ 0.015531555\ 0.750}{\pi(\frac{3}{8})^4\ 26.60}\ 0.405717417 \quad (33)$$

$$= 5.399397\ 10^6 \text{ psi}$$

Comparing the last two values of the modulii ($E_{to}$) to the initial buckling modulus ($E_{to}$) in Example 1, one concludes that in the stiffer members this modulus is much more reduced at the onset of buckling and of plastic yielding in the necks 6 of the connector pins. The same conclusion may be inferred by a comparison with the results in Example 2.

Test 1:

$$\frac{E_{to}I_p}{h} = \frac{\pi d^4 E_{to}}{64\,h} = \frac{\pi 0.375^4\ 6.222327\ 10^6}{64\ 0.693} = 8715.95 \text{ lb in}$$

Test 2:

$$\frac{E_{to}I_p}{h} = \frac{\pi d^4 E_{to}}{64\,h} = \frac{\pi 0.375^4\ 5.399397\ 10^6}{64\ 0.750} = 6988.42 \text{ lb in}$$

Figure 19:
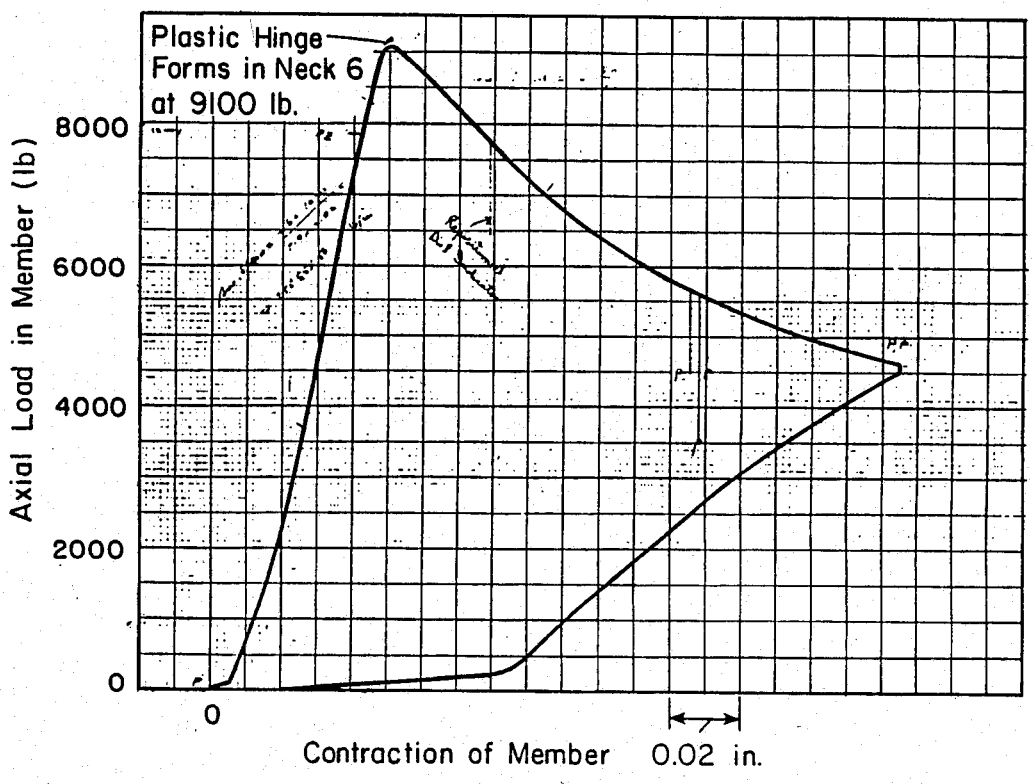
Figure 19A:
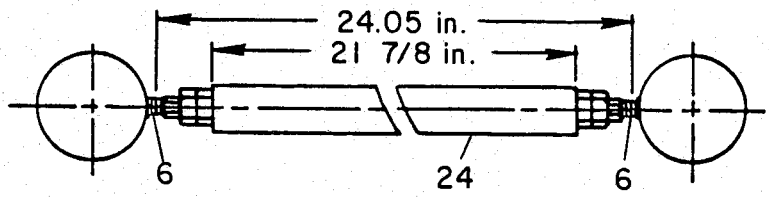
FIG. 19*a* shows the solid member 24.05 inches long and ¾ inches in diameter used in Test 3 described in Example 4 and characterized in FIG. 19.
Figure 19B:
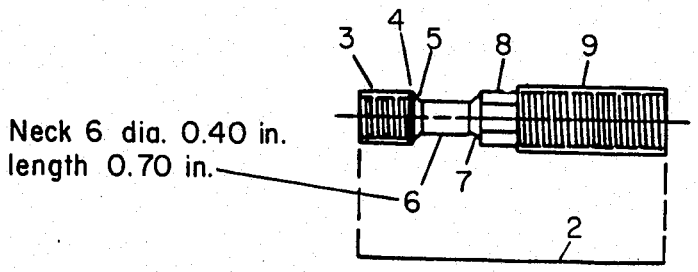
FIG. 19*b* shows the connector pin 2 with neck 6 of 0.40 inches in diameter and 0.70 inches in length used in Test 3 described in Example 4 and characterized in FIG. 19.

Test 3:

An even stiffer solid rod member, FIG. 19, made of a solid rod of $\frac{3}{4}$ inch diameter and a member length of 24.05 inches was tested for the formation of the plastic hinges in the necked-down portions 6 of the connector pins. As the axial load-contraction buckling curve from this test, FIG. 19, suggests, the initial yielding in the neck 6 takes place at first under an increase in the axial load to some 9100 lbs. Once this load is reached the plastic hinge develops fairly rapidly, its development being characterized by a sharper knee and the following decrease in the axial load.

In test 3 the diameter of the neck 6 in the pin of the specimen was 0.40 inch and its length was 0.70 inch. The ratio:

$$d/h = 0.40/0.70 = 0.571 \qquad 34$$

is now somewhat larger than in the previous two cases. This slightly larger ratio (h/d), however, does not seem to have a significant effect on the formation of the plastic hinge except to increase slightly the initial plastic buckling (peak) load on the axial load-contraction curve in Fig, 19.

The elastic stiffness of the member in Test 3:

$$\frac{EI}{L} = \frac{29.5\ 10^6\ 0.015531555}{24.05} = 19051.18 \text{ lb in}$$

The plastic hinge forms approximately at 9000 lb. (9100 lb. in FIG. 19). Thus:

$$p_o = 9000 \text{ lb} \qquad 36$$

and $$p_o = \frac{p_o L^2}{EI} = \frac{9000\ 24.05^2}{29.5\ 10^6\ 0.015531555} = 11.361501 \qquad 37$$

The plastic restraint contstant (k) of the pin (neck 6) is now:

$$k = \frac{11.361501}{\pi^2} - 1.151160729$$

Using Eq. (29), $$r_o = \frac{E_{to}I_p}{h} \Big/ \frac{EI}{L} = \frac{\pi d^4 E_{to} L}{64\ EIh} = 0.387792235 \qquad (38)$$

and $$E_{to} = \frac{64\ 29.5\ 10^6\ 0.015531555\ 0.70}{\pi 0.4^4\ 24.05}\ 0.387230286 \qquad (39)$$

$$= 4.109409\ 10^6 \text{ psi}$$

This suggests that the initial tangent modulus ($E_{to}$), at which buckling of the solid specimen becomes apparent, is further reduced in this case when the solid rod is made stiffer (shorter) compared with the results of the tests 1 and 2 in this Example.

The plastic stiffness of the pin, in this case:

$$\frac{E_{to}I_p}{h} = \frac{\pi d^4 E_{to}}{64\,h} = \frac{\pi 0.4^4 4{,}109{,}409}{64\ 0.70} = 7{,}377.19 \text{ lb in}$$

EXAMPLE 5

The model tetrahedron space element of FIG. 5, made of tubular members of 9/16 inches outside diameter and 0.020 inch thick connected by the connectors 2 having a necked-down region 6 was constructed. The length of the tube 15 and the bushings 12 and 16 was 17 $\frac{3}{4}$ inches. The effective length of the tetrahedron members, from the center of neck 6 to the center of neck 6 of the opposite pin, was approximately 19.00 inches. The connector pins 2 shown in FIG. 3 had the following dimensions: length of neck 6 was 0.182 inches, diameter of neck 6, 0.201 inches. The characteristic ratios d/h of the necks 6 of the connector pins were equal to 1.10 inches in this case. This means that the pins were fairly stiff. The thread 3 was 3/16 inches and the thread 9 5/16 inches. The tubular members 15 were attached to four spheres 30 of $1\frac{1}{4}$ inches diameter and secured and aligned by two locking 3/16 inch thick gem-nuts 10 and 11 at each end.

The tetrahedron was mounted onto a testing machine, so that the top joint was constrained to move in the vertical direction only. This was achieved by attaching to it a small horizontal plate, to which pressure was applied by the head of the machine. The bottom nodal spheres were supported by the base of the testing machine.

An L.V.D.T. (Linear Variable Differential Transformer) was used as a position transducer to measure the vertical displacement of the loaded top joint. This displacement and the load were recorded electronically on an x-y plotter and a vertical load-displacement diagram was obtained. The plastification process in the neck-down portions 6 of the connector pins 2 was monitored by direct observation.

The plastic hinges were observed to form simultaneously in the necks 6 of all the connector pins under the external load of approximately 2620,0 lbs. when the critical state of the tetrahedron was reached. This state was followed by a decrease in the applied load, accompanied by a further development of the plastic hinges in the connector pins in their necked-down portions 6, as recorded on diagram in FIG. 20.

It is of interest to mention that the plastic hinge was localized in the neck 6, despite of its fairly high characteristic ratio of 1.10, the frontal thread 3 was totally unaffected by the formation of the plastic hinge in the neck 6, as the nodal sphere could be easily unscrewed and the connector detached.

The entire tubular member of this tetrahedron was allowed to buckle and deform plastically at large deformations. Initially, at small deformations, the buckling of the tubular members was elastic, similarly as that shown for the tubular member in FIG. 14.

The compression tests described in the last section conducted on single tubular and solid members, connected by the special connectors, show that plastic hinges can be formed in the necked-down portions 6 of these connectors under a critical axial load ($P_o$). This value of the critical load depends on the restraining factor (k), the characteristic ratio (d/h) of the neck size, as well as on the ratio ($r_o$) of the flexural stiffness ($E_{to}$ $I_p$/h) of the neck 6 to the overall elastic flexural stiffness (EI/L) of the member.

Table 1 gives a summary of the significant quantities and parameters for these 4 tests. Of particular interest are the values of the restraining factor (k) and the characteristic ratio (d/h). Also, the ratio (rhd o) of the flexural stiffness of the necked-down portion 6 of the connector pin to the overall flexural stiffness of the member plays a significant role in the formation of these plastic hinges. (d/h) varies in these tests from 0.50 to 1.10 and the tests show that, in this range, the plastification of the neck can develop to a sufficient degree, so that plastic hinges can be formed. Ratios of (d/h) much below 0.5 are not desirable, because plastic buckling of the pin itself may be induced and the neck size 6 and the connector 2 become too long. A good range of these ratios for design purposes may be in the interval d/h=0.40 to 0.65. But, the choice is also conditioned somewhat by the ratio $$r_o = \left(\frac{E_{to}I_p}{h}\right) / \left(\frac{EI}{L}\right) = \frac{\pi d^3 E_{to} L}{64EI}\left(\frac{d}{h}\right) = \qquad \text{(Eq. 5)}$$

$$- \sqrt{p_o} \cot \tfrac{1}{2} \sqrt{p_o}$$

A high direct axial overstress of the neck in plastic compression diminishes this ratio to practically zero, as demonstrated by the two tests in Example 3. The connector pin then offers practically no flexural restraint to the formation of the plastic hinge and the critical axial load at which this happens tends to the Euler load, under which the member would buckle, if connected by real hinges. In such a case the restraining factor (k) is close to unity and, initially, the member behaves as if it were connected by real hinges.

The members are so designed that the critical load ($P_o$), at which the member buckles initially, occurs when the restraining factor (k) is close to unity (a good interval of values may be k=1.00 to 1.15), and the axial stress in the neck 6 of the connector pin is somewhat higher than the yield stress of the connector material. This then results in a practically simultaneous flexural buckling of the member and the plastification of the neck under a reduced plastic flexural resistance in the necked-down region 6 of the connector so that a plastic hinge can form there.

The formation of the plastic hinge in the neck 6 of the connector is enhanced if the initial value ($E_{to}$) of the tangent modulus, on the stress-strain curve, at which buckling commences is relatively low. When the neck is elastic, this modulus has the value of approximately $E=29.5\times10^6$ psi (for steels). As the plastification of the necked-down region 6 increases under the direct axial stress the so called tangent modulus ($E_t$) (gradient) on the stress-strain curve rapidly decreases around a knee of the stress-strain curve beyond the yield stress value and tends towards a constant value over a large range of plastic strains (some 0.020 in/in) known as the strain hardening range. The faster the tangent modulus is reduced—and this depends on the material of the connector pin, the amount of work hardening induced by the machining operations and on the extent of stress concentration in the necked-down region—the faster can the plastification of the neck proceed and the plastic hinge form.

FIG. 11 gives an explanation how the plastic strain reversal from compression to tension in the neck 6 of a connector pin causes a decrease in the axial load (P) under an increasing plastic moment ($M_{pl}$). FIG. 11.1 at the top shows the elevation view of the necked-down portion 6 with the adjacent regions 5 and 7 of the frontal and dorsal neck-down radii of the connector pin, before yielding in the neck takes place. The bottom part of this figure shows the stress distribution ($\sigma$) over the circular cross-sectional area of the neck 6. When integrated over the cross-sectional area, this stress distribution results in the axial load (P) shown in the Figure.

As (P) is increased, FIG. 11.2, a critical stress ($\sigma$) is reached at which yielding of the neck begins. The neck is always so designed, that at the same stress also the flexural buckling of the members begins. There, on the point of buckling, ($P=P_o$) and in the neck 6 ($\sigma=\sigma_o$).

In the initial stages of buckling the frontal and dorsal regions 5 and 7, respectively, adjacent to the neck 6 begin to rotate with respect to each other. However, these regions are not affected by the plastification process. The angle of this rotation is defined by ($\theta$). The fibers in the neck 6, which are on the convex side, eventually begin to unload, so that the stress in them diminishes and even becomes tensile. This phenomenon is called the strain or the stressreversal. The stress reversal is indicated in FIGS. 11.3 and 11.4 by the blackened regions on the stress diagram in tension.

The striped area on the stress-diagram in FIG. 11.3, integrated over the corresponding cross-sectional area of the neck 6, results in the axial load (P). It is obvious, that initially this integrated stress over the area of the neck may be larger than that shown in FIG. 11.2 by the area a, b, c, d integrated over the entire cross-section of neck 6 and equal to ($P_o$). Therefore, initially, as buckling of the member begins, the axial load (P) may increase from the initial value ($P_o$). This is indicated by FIG. 11.3 by ($P_{2>Po}$).

At the same time, the plastic moment ($M_{pl1}$) in the neck 6 is generated. It is represented by the couple of equal and opposite stress-resultants shown by the blackened spikes a, e, a', and a, e, h, a' on the stress diagrams in FIGS. 11.3 and 11.4, respectively. This plastic moment is responsible for the formation of the plastic hinge in the neck 6. As the buckling of the member, to which the connector pin with the neckeddown portion 6 is attached, and the yielding of this neck progress, also the relative rotation ($\theta$) between the frontal and the dorsal adjacent regions 5 and 7 respectively is increased. This causes the plastic moment ($M_{p12}$) to increase further as indicated by the larger blackened spikes on the stress-diagram in FIG. 11.4. But, this also makes the axial load (P) decrease, because now the striped area a', f, g', d on the stress-diagram in FIG. 11.4, when integrated over the corresponding portion of the cross-sectional area of the neck 6, is now smaller than that given by a', f, g, g', d' in FIG. 11.3 integrated over the corresponding portion of the cross-sectional area of the neck 6. Thus, at the stage, depicted in FIG. 11.4 ($P_3<P_o$) and ($M_{pl2}>M_{pl1}$).

FIG. 11.5 represents the stress-strain diagram for the material of the neck 6. In this case this material is a stainless steel with a fairly pronounced yield point (j) of some 67564 psi. In this region the curve has a rounded "knee" between the points (i) and (k) followed by a linear portion, the gradient of which is the plastic modulus (Ep =267612 psi). Initially, stress and strain are elastic, depicted by the portion (o, i) where the tangent is the elastic modulus (E =29,500,000 psi). Around the knee the tangent modulus decreases from (E) to Ep). ($E_{to}$) represents that value of the tangent modulus where buckling of the connected member and the hinging action in the neck 6 begin. Then, ($E_{to}$), represents the values used earlier in the explanation of the tests in the examples 1 to 4, and it is equal to the initial tangent modulus on the stress-strain curve for the material used in the connector pins 6, depicted in FIG. 11.5.

FIG. 11.6 shows the relationship between the axial load (P) and the contraction (Δh) of the necked-down region 6, which is similar to the relationships between the axial loads (P) and the overall contraction of the buckling members shown earlier for the specimens in the Examples 1 to 4. This relationship is characterized by an initial increase in the axial load (P) from its value ($P_o$), when buckling is supposed to begin, followed by a decrease in this load, as the plastic hinges are formed in the neck-down regions 6 of the respective connector pins.

The Eq. 5:

$$r_o = \frac{E_{to}I_p}{h} / \frac{EI}{L} = \frac{\pi d^4 E_{to} L}{64EIh} = -\sqrt{p_o}\cot\tfrac{1}{2}\sqrt{p_o}$$

is derived by calculating the plastic moment ($M_{pl}$) in the neck-down region 6 of the connector pin and equating this moment to the end-moment at the elastic tube or rod, restraining the elastic member (tube or solid rod) from buckling. (The complete theory is not reproduced in this document.)

It has been shown that a plastic hinge can form in the necked-down region 6 of a connector of the type 2 or 21 under a critical axial load for which the neck 6 is designed to yield plastically. Moreover, this is true for any tensile member attached by the same type of connectors. Tests were not performed to show this, because it is well known that under an eccentric tensile force, as shown in FIG. 10*d*, yielding in the neck is even more pronounced as its neck 6 deepens and so a plastic hinge can readily form. Thus, the members and their connectors can be so designed that under a critical value of the external load parameter, to which all axial loads in the members of a lattice are proportional, the potential for the formation of plastic hinges in the necked-down portions 6 of the connector pins exists in every member of the lattice, as described herein. This makes it possible to treat such a space lattice or truss as a quasi pin-jointed system, when the prescribed external loads, applied at the selected joints of the lattice, attain their critical values and the plastic hinges in the connectors can form. This property of such lattices makes it possible to consider the lattice as being actually hinged in the critical state and in the states beyond, characterized by the formation of a post-buckling kinematic mechanism within the system under critical external loads.

But, complex pin-jointed or hinged systems of this type lend themselves to analyses and optimizations for a superior strength and stability. Thus, the technical devices described herein and verified by tests reported in the Examples make it possible to apply these analyses and methodologies for the optimization for a relatively very high strength and stability to real structures, especially to large and complex space lattices and reticulated shells which may be used for the coverage of large areas or the enclosure of large volumes.

This theory and analysis can be also applied to other types of reticulated structures or lattices of arbitrary sizes, provided, such structures are loaded directly or indirectly through a cover-shell centrally at the nodes and supported on a firm foundation. Similarly, these theories and methods of optimization apply to larger unsupported structures used in outer space. These theories may also be used to analyze geodesic domes and other related non-conventional structures to improve or to predict their stability and strength.

In general, the methodologies differ qualitatively, depending on the type of connectors used in the lattice under consideration. If the connectors are quasi-hinged in all planes passing the member axis (as the special connectors in which plastic hinges can form) the analysis becomes very powerful and simpler than in the case of rigid or semi-flexible connectors.

In every case the analysis predicts correctly the critical region of loading, the critical state, in which an unstabilized structure may develop an unstable motion and collapse dynamically. The external loads are usually assumed to be proportional to a load parameter. The analysis then yields the critical value of this load parameter and the critical value of the external loads at which this collapse may occur. In practice, a lattice or truss is never loaded to this critical state, but well below, to ensure a safe performance of the structure.

Further, the analysis predicts quantitatively the changes in all external loads under all deformations of the lattice beyond the critical state when the lattice may be maintained in statical equilibrium by these loads. However, such an equilibrium is statically unstable, which means, that under a slight disturbance, which may be geometrical or physical, an unstabilized structure will develop a collapse motion and fail dynamically. In practical applications only those post-critical deformations are of interest which result in the largest decrease of the total potential energy (a standard technical concept) of the system (lattice and its conservative loading). These deformations constitute the most degrading buckling mode of a pin-jointed lattice related to the given external loads. Such a mode may develop in states of postbuckling equilibrium or during the collapse by motion.

Analysis, therefore, enables one to evaluate this mode in equilibrium for complex pin-jointed structures of the type described herein, by means of the solution of problem involving a minimization of the total potential energy function of the system subject to some lionear statical and kinematic restraints. This analysis applies to quasi pin-connected lattices only. Both methods lend themselves to further optimization techniques. One such technique permits an optimization of the lattice by stiffening certain members so that the most degrading mode may be eliminated and the stability and the strength of the lattice improved.

In practice, there are always initial minute geometrical imperfections present in the lattice and in the members themselves, such as some initial curvature slight eccentricities at the joints, etc. Imperfections may also be present in the connectors, such as minute or intrinsic geometrical or material imperfections in the critical locations of the connector pin. These obviously affect the shape of the equilibrium paths or curves compared to those obtained from theory in which these minute imperfections are not or cannot be considered profitably. One effect of these imperfections is to obliterate the distinction between the prebuckling portion of the equilibrium curves and the post-buckling portions of these curves or paths. This obliteration results in a rounded knee on the curves in the critical regions, which may result in a peak load if the curves are statically unstable beyond the critical state, as already described in the previous sections. Thus, the theoretical critical state occurs very close to the actual critical state at a peak value of the external load parameter, as in the case of the tetrahedron in FIG. 20. The equilibrium curve, modified by these imperfections, always tends to the theoretical post-buckling equilibrium path in the corresponding mode of post-buckling deformation, which can be reliably predicted by the analysis.

The analysis of quasi pin-jointed lattices requires only that the plastic hinges or pins may form physically in the critical state of the lattice under the prescribed system of external loads. In the case of the systems described herein, this is ensured by the mechanical connector-pin such as 2 or 21. Other types of connectors consistent with the teachings herein may be used. The plastic hinges at the necks 6 of these connector pins are formed by the stress-concentration under the action of the axial loads in the critical or nearcritical states in the members, corresponding to the global critical state of the lattice.

It should be pointed out that other types of pin-jointed connectors which display a real hinge action in particular planes only may be known. The analysis described herein may be readily applicable to lattices jointed by such different hinges or connectors.

The special connectors 2 and 21, with the plastic hinges forming in their neck-down regions 6, adjacent to the nodal spheres 30, make these spheres particularly safe from axial overstress and from failure by fracture or embrittlement. The connector pins are so designed, that their yielding in the neck-down regions 6 limits or relieves the axial stresses to their prescribed critical values, which are such that the local overstress of the nodal spheres is prevented. Many existing systems use rigid connectors that are welded to the nodal spheres which become embrittled. Such systems are known to have failed by brittle fracture of the joints.

TABLE 1

SUMMARY OF THE TEST RESULTS

| SPECIMEN | EXAMPLE (1) Tubular (stainless steel) | EXAMPLE (2) Tubular (stainless steel) | EXAMPLE (3) Test (1) Solid (stainless steel) | EXAMPLE (3) Test (2) Solid (stainless steel) |
|---|---|---|---|---|
| D — outside diameter of tube or solid rod | $\frac{9}{16}$ = 0.5625 in | $\frac{9}{16}$ = 0.5625 in | 0.50 in | 0.50 in |
| t — Thickness of tube | 0.020 in | 0.020 in | | |
| I — Moment of Inertia of tube of solid rod cross-sections | 0.00125568 in$^4$ | 0.00125568 in$^4$ | 0.00306796 in$^4$ | 0.00306796 in$^4$ |
| L — Effective Length of Member Under Test | 24.32 in | 20.26 in | 24.3825 in | 24.3825 in |
| E — Elastic Modulus of tube or rod | 29,500,000 psi | 29,500,000 psi | 29,500,000 psi | 29,500,000 psi |
| $\frac{EI}{L}$ — Elastic Stiffness of Member | 1523.13 lb in | 1828.36 lb in | 3711.88 lb in | 3711.88 lb in |
| h — Length of Neck (6) | $\frac{1}{4}$ = 0.25 in | $\frac{5}{16}$ = 0.3125 in | 0.280 in | $\frac{5}{16}$ = 0.3125 in |
| d — Diameter of Neck (6) | $\frac{1}{8}$ = 0.125 in | $\frac{5}{32}$ = 0.15625 in | $\frac{3}{16}$ = 0.1875 | $\frac{3}{32}$ = 0.15625 in |
| $\frac{d}{h}$ Characteristic Ratio of Neck (6) | 0.50 | 0.50 | 0.670 | 0.50 |
| $\frac{E_{to} I_p}{h}$ — Plastic Stiffness of Connector pin | 985.04 | 1598.38 lb in | 291.84 lb in | = 0 |
| $P_o$ — Initial Axial Buckling Load | 770 lb | 1180 lb | 1550 lb | 1500 lb |
| $P_o = P_oL^2/EI$ | 12.294670 | 13.075548 | 10.181603 | 9.853164 |
| k — Restraint Factor of the Plastic Hinges | 1.245710 | 1.324830 | 1.0316621 | 0.998 |
| $E_{to}$ — Tangent Modulus in Neck at Buckling | 20,548,685 | 17,071,785 psi | 1,346,863 psi | = — |
| $r_o = \frac{E_{to}I_p}{h} / \frac{EI}{L}$ Ratio of Stiffness | 0.646720 | 0.874213 | 0.078622 | + 0 |

| SPECIMEN | EXAMPLE (4) Test (1) Solid (Stainless steel) | EXAMPLE (4) Test (2) Solid (stainless steel) | EXAMPLE (4) Test(3) Solid (stainless steel) | EXAMPLE (5) Single Tubular Member (stainless steel) |
|---|---|---|---|---|
| D — outside diameter of tube or solid rod | 0.75 in | 0.75 in | 0.75 in | $\frac{9}{16}$ = 0.5625 in |
| t — Thickness of tube | | | | 0.020 in |
| I — Moment of Inertia of tube or solid rod | 0.0155315 in$^4$ | 0.0155315 in$^4$ | 0.0155315 in$^4$ | 0.00125568 in$^4$ |
| L — Effective Length of Member Under Test cross-sections | 26.670 in | 26.60 in | 24.05 in | 19.00 in |
| E — Elastic Modulus of tube or rod | 29,500,000 psi | 29,500,000 psi | 29,500,000 psi | 29,500,000 psi |
| $\frac{EI}{L}$ — Elastic Stiffness of Member | 17179.64 lb in | 17224.84 lb in | 19051.18 lb in | 1949.61 lb in |
| h — Length of Neck (6) | 0.693 in | $\frac{3}{4}$ = 0.75 in | 0.70 in | 0.182 in |
| d — Diameter of Neck (6) | $\frac{3}{8}$ = 0.375 in | $\frac{3}{8}$ = 0.375 in | 0.40 in | 0.201 in |
| $\frac{d}{h}$ Characteristc Ratio of Neck (6) | 0.541 | 0.50 | 0.571 | 1.104 |
| $\frac{E_{to}I_p}{h}$ — Plastic Stiffness of Connector pin | 8715.95 lb in | 6988.42 lb in | 7377.19 in | 2,269.78 lb in |
| $P_o$ — Initial Axial Buckling Load | 7600 lb | 7400 lb | 9000 lb | 1439 lb |
| $P_o = P_oL^2/EI$ | 11.798388 | 11.427679 | 11.361501 | 14.021113 |
| k — Restraint Factor of the Plastic Hinges | 1.195427 | 1.157866 | 1.151161 | 1.420636 |

TABLE 1-continued

| SUMMARY OF THE TEST RESULTS | | | | |
|---|---|---|---|---|
| $E_{to}$ — Tangent Modulus in Neck at Buckling | 6,222,327 psi | 5,399,397 psi | 4,109,409 psi | 5,155,859 psi |
| $r_o = \frac{E_{to}I_p}{h} / \frac{EI}{L}$ Ratio of Stiffness | 0.507342 | 0.405717 | 0.387792 | 1.164224 |

I claim:

1. A straight elongate structural member capable rigid mounting at its ends into a reticulated structure to form one of a plurality of structural members forming that structure, said member comprising one or more straight elongate elements serially interconnected with a load responsive means which at working loads axially applied to the member is rigid and which at a desired predetermined load, in excess of said working loads, axially applied to the member becomes plastically deformable said predetermined load being less than the critical load of said member when rigidly supported at its ends.

2. A member according to claim 1 wherein said predetermined load is in the critical region of loading, determined as if said member were an axially loaded member of perfect geometry supported at its ends by ideal hinges.

3. A member according to claim 2 wherein said region is in the range of approximately 100% to approximately 130% of the load so determined.

4. A member according to claim 3 wherein said range is approximately 100% to approximately 115%.

5. A member according to claim 1 wherein said characteristics of said means are determined by choice of material thereof and by the size and shape of said means.

6. A member according to claim 5 wherein said means is of a smaller cross-section than the cross-section of the remainder of the member and is of an axial length chosen relative to its cross-section to provide said characteristics.

7. A member according to claim 1 wherein a said means is disposed in said member adjacent each said end thereof.

8. A member according to claim 1 further comprising a connector element by which said member may be removably connected into said structure.

9. A member according to claim 8 wherein said connector element incorporates said means therein.

10. A member according to claim 9 wherein a said connector element is disposed in said member to define each said end.

11. A reticulated structure comprising a network of straight elongate structural members rigidly interconnected at structural nodes, at least one of said members comprising a straight elongate element serially interconnected with a load responsive means which at working loads axially applied to the member is rigid and which at a desired predetermined load, in excess of said working loads, axially applied to the member becomes plastically deformable said predetermined load being less than the critical load of said member when rigidly supported at its ends.

12. A structure according to claim 11 wherein a plurality of said members each comprise a straight elongate element serially interconnected with a load responsive means which at working loads axially applied to the member is rigid and which at a desired predetermined load, in excess of said working loads, axially applied to the member becomes plastically deformable said predetermined load being less than the critical load of said member when rigidly supported at its ends.

13. A structure according to claim 11 wherein all said members comprise a straight elongate element serially interconnected with a load responsive means which at working loads axially applied to the member is rigid and which at a desired predetermined load, in excess of said working loads, axially applied to the member becomes plastically deformable said predetermined load being less than the critical load of said member when rigidly supported at its ends.

14. A structure according to claim 12 wherein said members not forming said plurality and said plurality of members are located relative to one another in said structure whereby upon application of forces to the structure potentially able to cause sudden catastrophic collapse thereof, said means of at least one of said plurality of members will plastically deform to relieve said forces thereby to prevent said catastrophic collapse.

15. A structure according to claim 14 wherein said members not forming said plurality have critical regions of loading of greater magnitude than those of said plurality thereby to ensure controlled deformation of portions of said structure incorporating said plurality in preference to portions of said structure incorporating said members not incorporating said plurality.

16. A structure according to claim 11 wherein said members have a slenderness ratio in excess of 40.

17. A structure according to claim 11 wherein said ratio is in excess of 100.

18. A structure according to claim 11 wherein said predetermined load is in the critical region of loading, determined as if said member were an axially loaded member of perfect geometry supported at its ends by ideal hinges.

19. A structure according to claim 18 wherein said region is in the range of approximately 100% to approximately 130% of the load so determined.

20. A structure according to claim 19 wherein said range is approximately 100% to approximately 115%.

21. A structure according to claim 19 wherein a said connector element is disposed in said member to define each said end.

22. A structure according to claim 11 wherein said characteristics of said means is determined by choice of material thereof and by the size and shape of said means.

23. A structure according to claim 22 wherin said means is of a smaller cross-section than the cross-section of the remainder of the member and is of an axial length chosen relative to its cross-section to provide said characteristics.

24. A structure according to claim 11 wherein a said means is disposed in said member adjacent each said end thereof.

25. A structure according to claim 11 further comprising a connector element by which said member may be removably connected into said structure.

26. A structure according to claim 25 wherein said connector element incorporates said means therein.

27. A structural member capable of being employed in reticulated structures comprising:

a relatively slender structural element;

at least one end connector means affixed to said structural element to form a structural member for attachment to other structural members, said end connector means including connecting element means, being normally rigid and fabricated so as to be capable of plastic deformation at or near the critical region of loading of the structural element so as to permit the formation of a plastic hinge in the connecting element means, the critical region of loading being determined for an axially loaded member of perfect geometry supported by ideal hinges.

28. A connector for use between structural elements in a reticulated structure comprising:

a normally rigid quasi-pin joint connector connected to a structural element;

node means for connecting at least one structural element through a quasi-pin joint connector to another structural element;

said quasi-pin joint connector being selected of preselected materials and dimensioned so as to be plastically deformable and rotatable at or near the critical region of loading of the structural element the critical region of loading being determined for an axially loaded member of perfect geometry supported by ideal hinges.

29. A structural system consisting at least in part of relatively slender members comprising;

a plurality of structural member means; and connector means for connecting such structural member means and including node means and pin means wherein said pin means is connected to at least one structural member means and at least one node means, and said pin means being comprised of materials in a size and shape to be capable of plastic deformation and a degree of rotation at or near the critical region of loading of said structural member means, the critical region of loading being determined for an axially loaded member of perfect geometry supported by ideal hinges.

30. A reticulated structure comprising a plurality of structural members connected together wherein a preselected number of the connectors contain quasi-pin joints designed to form plastic hinges at or near the critical region of loading of the structure, the critical region of loading being determined for an axially loaded member of perfect geometry supported by ideal hinges.

31. A rigid reticulated structure comprising a plurality of straight elongate structural members interconnected by a plurality of nodal connecting elements wherein at least one of said members incorporates normally rigid means which at a desired predetermined load, axially applied to said at least one said member, reaches a magnitude of stress permitting plastic deformation of said means thereby to relieve said stress, said load representing a loading of said structure greater than normal working loading thereof while being low enough to permit controlled deformation of said structure rather than sudden catastrophic collapse thereof.

32. A structure according to claim 31 wherein said means is incorporated as a necked down portion of a connecting element, one of said elements being disposed at each end of said at least one said member.

* * * * *